US008454139B2

(12) United States Patent
Ishizawa et al.

(10) Patent No.: US 8,454,139 B2
(45) Date of Patent: Jun. 4, 2013

(54) LIQUID ACCOMMODATING CONTAINER, TANK UNIT, AND LIQUID EJECTING SYSTEM

(75) Inventors: Taku Ishizawa, Shiojiri (JP); Yoshiaki Shimizu, Matsumoto (JP); Yuki Takeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 144 days.

(21) Appl. No.: 13/183,383

(22) Filed: Jul. 14, 2011

(65) Prior Publication Data

US 2012/0013687 A1 Jan. 19, 2012

(30) Foreign Application Priority Data

Jul. 15, 2010 (JP) ..... 2010-160364

(51) Int. Cl.
*B41J 2/175* (2006.01)

(52) U.S. Cl.
USPC ..... 347/85; 347/86; 347/84; 347/87

(58) Field of Classification Search
CPC ..... B41J 2/175
USPC ..... 347/85
See application file for complete search history.

(56) References Cited

U.S. PATENT DOCUMENTS 6,036,305 A * 3/2000 Nagasaki et al. ..... 347/86
7,101,022 B2 9/2006 Mui et al.
7,125,108 B2 * 10/2006 Toba et al. ..... 347/86
7,175,264 B2 * 2/2007 Qingguo et al. ..... 347/85
7,513,613 B2 * 4/2009 Ishizawa et al. ..... 347/86
7,540,598 B2 * 6/2009 Hori et al. ..... 347/86
7,543,925 B2 * 6/2009 Ishizawa et al. ..... 347/85
7,581,808 B2 * 9/2009 Ishizawa et al. ..... 347/19
7,635,180 B2 * 12/2009 Hattori et al. ..... 347/86
7,699,453 B2 * 4/2010 Ishizawa et al. ..... 347/86
7,997,708 B2 * 8/2011 Chung et al. ..... 347/87
8,128,211 B2 * 3/2012 Chung et al. ..... 347/86
2006/0139424 A1 * 6/2006 Miyazawa et al. ..... 347/86
2006/0203053 A1 * 9/2006 Katsumura ..... 347/86
2008/0012915 A1 * 1/2008 Ishizawa et al. ..... 347/86
2008/0018718 A1 * 1/2008 Ishizawa et al. ..... 347/86
2008/0036808 A1 * 2/2008 Shinada et al. ..... 347/11

(Continued)

FOREIGN PATENT DOCUMENTS

JP 2004-209847 A 7/2004
JP 2005-199693 A 7/2005

(Continued)

*Primary Examiner* — Matthew Luu
*Assistant Examiner* — Lily Kemathe
(74) *Attorney, Agent, or Firm* — Kilpatrick Townsend & Stockton LLP

(57) ABSTRACT

A liquid accommodating container in which in a use position, a port opened to the air is provided at a position that is closer to an air chamber uppermost surface and is included in a first corner portion, an air-side opening is provided at a position that is closer to an air chamber lowermost surface and is included in a second corner portion which is at a diagonal position to the first corner portion, and a liquid-side opening is provided at a position satisfying the following conditions (a) and (b), (a) a position closer to a liquid chamber lowermost surface with respect to the vertical direction in the use position and (b) a position which is included in the second corner portion that is at a position equivalent to a diagonal position to the first corner portion.

15 Claims, 18 Drawing Sheets

U.S. PATENT DOCUMENTS

| | | | | |
|---|---|---|---|---|
| 2008/0049079 | A1* | 2/2008 | Ishizawa et al. | 347/86 |
| 2008/0204527 | A1* | 8/2008 | Yuen | 347/86 |
| 2008/0278556 | A1* | 11/2008 | Chung et al. | 347/86 |
| 2008/0284832 | A1* | 11/2008 | Chung et al. | 347/86 |
| 2009/0073245 | A1* | 3/2009 | Chung et al. | 347/87 |
| 2009/0102897 | A1* | 4/2009 | Mizutani et al. | 347/85 |
| 2009/0102902 | A1* | 4/2009 | Nose et al. | 347/86 |
| 2009/0237474 | A1* | 9/2009 | Ishizawa et al. | 347/86 |
| 2009/0237475 | A1* | 9/2009 | Ishizawa | 347/86 |
| 2009/0322838 | A1* | 12/2009 | Wanibe et al. | 347/86 |
| 2009/0322839 | A1* | 12/2009 | Ishizawa et al. | 347/86 |
| 2010/0013896 | A1* | 1/2010 | Ishizawa et al. | 347/86 |
| 2012/0038719 | A1* | 2/2012 | Shimizu et al. | 347/86 |

FOREIGN PATENT DOCUMENTS

| | | | |
|---|---|---|---|
| JP | 2005-219483 | A | 8/2005 |
| JP | 2005-001284 | A | 1/2006 |
| JP | 2007-253328 | A | 10/2007 |

* cited by examiner

USE POSITION

INJECTION POSITION

REMAINING AMOUNT OF INK: SMALL

STATE BEFORE INK INJECTION

STATE AFTER INK INJECTION

USE POSITION: HIGH TEMPERATURE

USE POSITION: LOW TEMPERATURE

INJECTION POSITION: LOW TEMPERATURE

INJECTION POSITION: HIGH TEMPERATURE

UPSIDE-DOWN POSITION

POSITION IN WHICH INJECTION PORT IS DOWNWARD

LIQUID ACCOMMODATING CONTAINER, TANK UNIT, AND LIQUID EJECTING SYSTEM

This application claims priority to Japanese Patent Application No. 2010-160364, filed Jul. 15, 2010, the entirety of which is incorporated by reference herein.

BACKGROUND

1. Technical Field

The present invention relates to a liquid accommodating container, a tank unit provided with a plurality of liquid accommodating containers, and a liquid ejecting system provided with the liquid accommodating containers.

2. Related Art

A printer that is one example of a liquid ejecting apparatus performs printing by discharging ink from a recording head onto a recording target (for example, printing paper). As the technique of supplying ink to a recording head, a technique of supplying ink from an ink cartridge disposed on a recording head to the recording head and also supplying ink from an ink tank disposed outside a liquid ejecting apparatus to the ink cartridge or the head through a tube is known (for example, JP-A-2005-219483, JP-A-2005-1284, and JP-A-2005-199693). The ink tank can contain a large volume of ink compared to the ink cartridge. Further, the ink tank is provided with an ink injection port, so that a user can easily inject (replenish) ink from the ink injection port.

JP-A-2007-253328 and JP-A-2004-209847 are examples of the related art.

The ink tank is provided with an ink injection port for injecting ink and a gas suction port (a flow path opened to the air) for introducing air into the ink tank, as in JP-A-2005-219483. The ink injection port is blocked by a removable plug. On the other hand, in order to make air be taken from the outside into the ink tank in accordance with consumption of ink, the flow path opened to the air needs to be configured such that at least gas (air) can be ventilated.

Therefore, if the state of the ink tank changes in a state where ink is contained in the ink tank, there is a case where ink flows out from the flow path opened to the air toward the outside. For example, if the position of the ink tank changes due to transportation or the like of the ink tank, there is a case where ink flows out from the flow path opened to the air toward the outside. Further, there is a case where air in the ink tank expands due to, for example, a change in the temperature of the inside of the ink tank, so that ink is extruded to the flow path opened to the air.

Such problems are not limited to the ink tank and are problems common to a liquid accommodating container which is for accommodating therein liquid that a liquid ejecting apparatus ejects and in which a liquid injection port and a flow path opened to the air are separately provided.

SUMMARY

An advantage of some aspects of the invention is that it provides a technique by which in a liquid accommodating container in which a liquid injection port and a flow path opened to the air are separately provided, even in a case where the state of the liquid accommodating container has changed, a possibility that liquid may flow out from the flow path opened to the air toward the outside can be reduced.

The invention can be realized as the following aspects or applications.

Application 1

A liquid accommodating container for supplying liquid to a liquid ejecting apparatus, including: a liquid accommodating chamber for accommodating the liquid; a liquid injection port which is for injecting the liquid into the liquid accommodating chamber and on which a plug member that blocks the liquid injection port is detachably mounted; a flow path opened to the air for introducing external air into the liquid accommodating chamber in accordance with consumption of the liquid in the liquid accommodating chamber; and a lead-out flow path having one end portion disposed in the liquid accommodating chamber and the other end portion opened toward the outside, thereby making the liquid in the liquid accommodating chamber flow toward the outside, wherein the flow path opened to the air includes an air accommodating chamber which has a given volume and is located above the liquid accommodating chamber in an injection position of the liquid accommodating container when injecting the liquid into the liquid accommodating chamber, a first flow path having one end portion opened in the air accommodating chamber and the other end portion opened toward the outside, thereby making the air accommodating chamber communicate with the outside, and a second flow path having one end portion opened in the air accommodating chamber and the other end portion opened in the liquid accommodating chamber, thereby making the air accommodating chamber and the liquid accommodating chamber communicate with each other, and capable of holding the liquid by forming a meniscus, and in a use position of the liquid accommodating container when supplying the liquid to the liquid ejecting apparatus, a port opened to the air that is one end portion of the first flow path is provided at a position that is closer to an air chamber uppermost surface than an air chamber middle point which is the middle point of a line segment connecting the air chamber uppermost surface and an air chamber lowermost surface of the air accommodating chamber, with respect to the vertical direction, and that is included in a first corner portion which is one of four corner portions of a first rectangular outermost frame projection plane which is a vertical projection plane which is formed when an inner face of the air accommodating chamber is vertically projected vertically downward in the use position, an air-side opening that is one end portion of the second flow path is provided at a position that is closer to the air chamber lowermost surface than the air chamber middle point and is included in a second corner portion which is at a diagonal position to the first corner portion, among the four corner portions of the outermost frame projection plane, and a liquid-side opening that is the other end portion of the second flow path is provided at a position satisfying the following conditions (a) and (b), (a) a position closer to a liquid chamber lowermost surface than a liquid chamber middle point which is the middle point of a line segment connecting a liquid chamber uppermost surface and the liquid chamber lowermost surface of the liquid accommodating chamber, with respect to the vertical direction in the use position, and (b) a position which is included in a third corner portion that is one of four corner portions of a second rectangular outermost frame projection plane which is a vertical projection plane which is formed when an inner face of the liquid accommodating chamber is vertically projected vertically downward in the use position, and that is at a position equivalent to a diagonal position to the first corner portion in the first rectangular outermost frame projection plane.

According to the liquid accommodating container stated in Application 1, the flow path opened to the air includes the air accommodating chamber having a given volume, between the first flow path and the liquid accommodating chamber. Accordingly, even in a case where air in the liquid accommodating chamber expands due to a change in external temperature, whereby liquid in the liquid accommodating chamber flows to the flow path side opened to the air, the liquid can be retained by the air accommodating chamber. Further, the port opened to the air, the air-side opening, and the liquid-side opening are disposed at the positions stated in Application 1, whereby even in a case where the liquid accommodating container has been made to be in a use position, an upside-down position reverse to the use position, and a position lying on its side, a possibility that liquid may flow out from the flow path opened to the air toward the outside can be reduced. That is, a possibility that liquid may flow out from the port opened to the air to the flow path opened to the air can be reduced.

Application 2

In the liquid accommodating container stated in Application 1, the liquid injection port may be provided at an air-side wall surface on the side where the air accommodating chamber is disposed with respect to the liquid accommodating chamber, among wall surfaces partitioning and forming the liquid accommodating chamber, and in the injection position, the air-side wall surface of the liquid accommodating chamber may become a top face.

According to the liquid accommodating container stated in Application 2, when a user injects (replenishes) liquid into the liquid accommodating chamber, it is possible to urge the user to make a position an injection position. In the injection position, since the liquid accommodating chamber is located below the air accommodating chamber, a possibility that liquid may flow up to the air accommodating chamber at the time of liquid injection can be reduced. Accordingly, in a use position, it is possible to make the height position of a liquid surface directly contacting with air be within a given range (about the height position of the second flow path). Accordingly, it is possible to stably supply liquid to the liquid ejecting apparatus.

Application 3

In the liquid accommodating container stated in Application 1 or 2, a liquid outlet that is one end portion of the lead-out flow path may be provided in the liquid accommodating chamber so as to be located at a position closer to a lowermost surface among a liquid chamber middle point that is the middle point of a line segment connecting an uppermost surface and the lowermost surface of the liquid accommodating chamber and the lowermost surface, with respect to the vertical direction in each of the injection position and the use position of the liquid accommodating container.

According to the liquid accommodating container stated in Application 3, in the use position, since the liquid outlet is located closer to the outermost surface of the liquid accommodating chamber, the remaining amount of liquid in the liquid accommodating chamber can be reduced. Further, in the injection position, since the liquid outlet is located closer to the outermost surface of the liquid accommodating chamber, even in a case where the liquid accommodating container has been made to be in the injection position in a state where the remaining amount of liquid in the liquid accommodating chamber has become small, a state where a liquid surface in the liquid accommodating chamber is at a higher position than the liquid outlet can be more reliably maintained. That is, in the injection position, a state where the liquid outlet contacts with liquid in the liquid accommodating chamber without intervention of air can be more reliably maintained. Accordingly, a possibility that air may flow to the liquid ejecting apparatus side through the liquid outlet at the time of liquid injection can be reduced.

Application 4

In the liquid accommodating container stated in any one of Applications 1 to 3, the liquid accommodating chamber, the air accommodating chamber, and the second flow path may be formed by a container main body of a concave shape in which one face is opened, and a film which blocks the opening.

According to the liquid accommodating container stated in Application 4, the liquid accommodating chamber, the air accommodating chamber, and the second flow path can be easily formed by the container main body of a concave shape and the film which blocks the opening of the container main body. Further, the airtightness of the inside of the liquid accommodating container can be easily secured.

Application 5

The liquid accommodating container stated in Application 4 my further include a cover member that is for protecting the film and covers the film.

According to the liquid accommodating container stated in Application 5, the airtightness of the inside of the liquid accommodating container can be easily secured by the film and liquid leakage due to breakage of the film can also be prevented.

Application 6

A tank unit including: a plurality of liquid accommodating containers which is the liquid accommodating containers stated in Application 4 and in which a facing wall surface portion facing the opening has approximately the same shape as the opening, wherein the plurality of liquid accommodating containers is stacked such that the film of one liquid accommodating container is covered by the facing wall surface portion of the other adjacent liquid accommodating container.

According to the tank unit stated in Application 6, since the film of one liquid accommodating container can be protected by the container main body of the other liquid accommodating container, a tank unit in which a plurality of liquid accommodating containers is combined while compactifying it can be formed.

Application 7

A tank unit including: two liquid accommodating containers stated in Application 4, wherein each facing wall surface portion facing each opening of the two liquid accommodating containers is constituted by a single common member, and the two container main bodies are integrally molded.

According to the tank unit stated in Application 7, it is possible to easily form two liquid accommodating containers. Further, since it is possible to form substantially two liquid accommodating containers by single molding, it is possible to improve the production efficiency of the liquid accommodating container.

Application 8

A liquid ejecting system including: the liquid accommodating container stated in any one of Applications 1 to 4; a liquid ejecting apparatus which includes a head for ejecting the liquid onto a target; and a flow tube that connects the liquid accommodating container and the liquid ejecting apparatus, thereby the liquid in the liquid accommodating chamber flow to the liquid ejecting apparatus.

According to the liquid ejecting system stated in Application 8, a liquid ejecting system can be provided which supplies liquid to the liquid ejecting apparatus by using the liquid accommodating container in which a possibility that liquid may flow out from the flow path opened to the air toward the outside is reduced.

Application 9

In the liquid ejecting system stated in Application 8, the liquid ejecting apparatus may be a printer, and the liquid accommodating chamber of the liquid accommodating container may accommodate ink.

According to the liquid ejecting system stated in Application 9, a liquid ejecting system can be provided which supplies ink to the printer by using the liquid accommodating container in which a possibility that ink may flow out from the flow path opened to the air toward the outside is reduced.

In addition, the invention can be realized in various aspects and can be realized in aspects such as a manufacturing method of the above-described liquid accommodating container and a liquid ejecting method using the above-described liquid ejecting system, besides the above-described liquid accommodating container, the tank unit, and the liquid ejecting system provided with a liquid ejecting apparatus and a liquid accommodating container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the flowing order.

A. First Example

B. Second Example

C. Modified Example

A. FIRST EXAMPLE

A-1. Configuration of Liquid Ejecting System

Figure 1A:
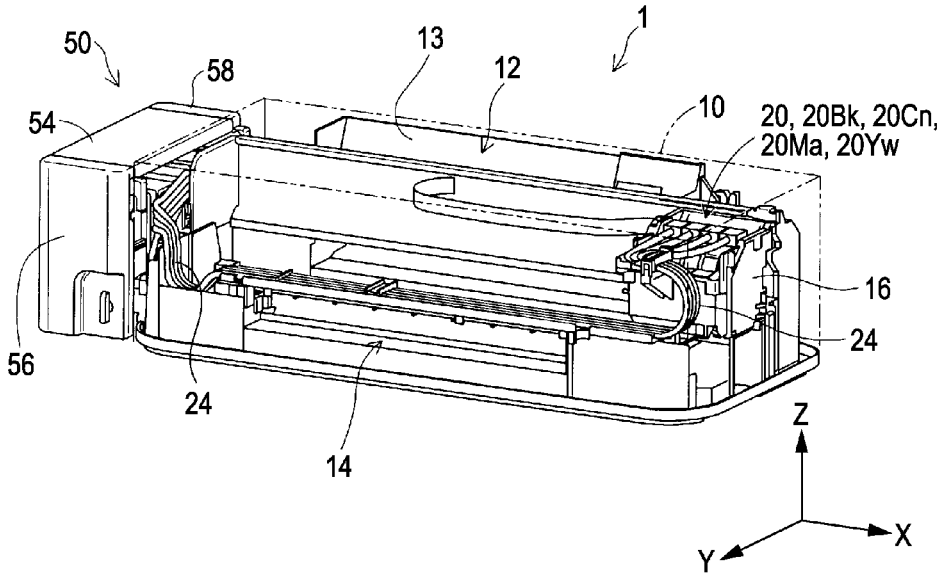
FIGS. 1A and 1B are diagrams for describing a liquid ejecting system of the first example.
Figure 1B:
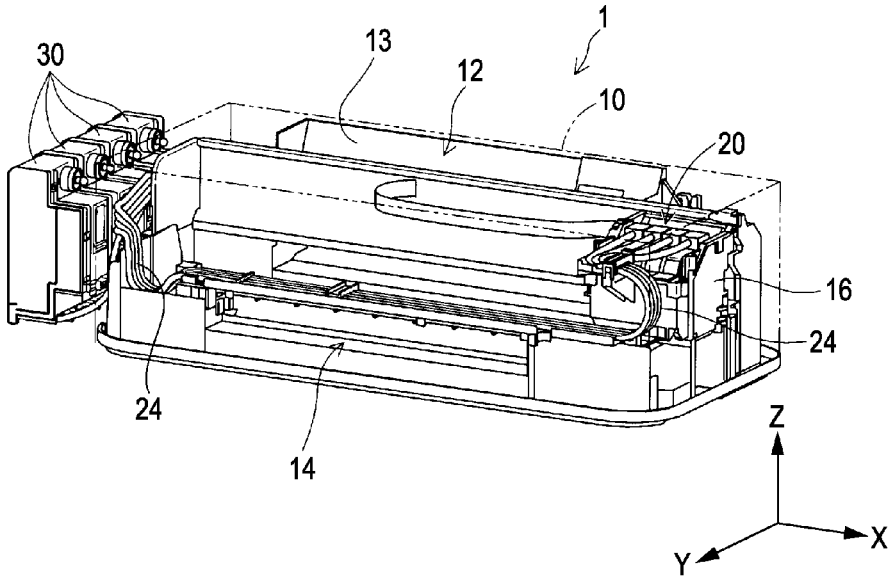

FIGS. 1A and 1B are diagrams for describing a liquid ejecting system 1 of the first example. FIG. 1A is an exterior perspective view of the liquid ejecting system 1. FIG. 1B is an exterior perspective view of the liquid ejecting system 1 and is a diagram illustrating liquid accommodating containers 30 of the first example of the invention. In addition, in FIGS. 1A and 1B, X, Y, and Z axes being right angles to each other are shown in order to specify a direction. In addition, also with respect to the subsequent drawings, the X, Y, and Z axes are shown as necessary.

As shown in FIG. 1A, the liquid ejecting system 1 includes an ink jet printer 12 (also simply referred to as a "printer 12") as a liquid ejecting apparatus, and a tank unit 50. The printer 12 includes a paper feed section 13, a paper discharge section 14, a carriage 16 and four sub-tanks 20. The four sub-tanks 20 contain ink of different colors. Specifically, the four sub-tanks 20 are a sub-tank 20Bk that contains black ink, a sub-tank 20Cn that contains cyan ink, a sub-tank 20Ma that contains magenta ink, and a sub-tank 20Yw that contains yellow ink. The four sub-tanks 20 are mounted on the carriage 16.

Printing paper set in the paper feed section 13 is transported to the inside of the printer 12 and the printing paper after printing is discharged from the paper discharge section 14.

The carriage 16 is movable in a main scanning direction (a paper width direction). This movement is performed through a timing belt (not shown) by the driving of a stepping motor (not shown). A recording head (not shown) is provided and mounted on the lower surface of the carriage 16. Ink is ejected from a plurality of nozzles of the recording head onto the printing paper, whereby printing is performed. In addition, various components constituting the printer 12, such as the timing belt or the carriage 16, are housed inside a case 10, being protected thereby.

The tank unit 50 includes a top case 54, a first side case 56, and a second case 58. These cases 54, 56, and 58 are molded by synthetic resin such as polypropylene or polystyrene. Further, as shown in FIG. 1B, the tank unit 50 is provided with ink tanks 30 as four liquid accommodating containers inside the cases (cover members) 54, 56, and 58. The tank unit 50 is more stably installed at a given place (for example, a desk or a shelf) by the cases 54, 56, and 58. The four ink tanks 30 contain ink corresponding to colors that the four sub-tanks 20 contain. That is, the four ink tanks 30 respectively contain black ink, cyan ink, magenta ink, and yellow ink. In addition, the ink tank 30 can contain a larger amount of ink than the sub-tank 20.

The ink tank 30 with ink of each color contained is connected to the sub-tank 20 containing ink of a corresponding color by a hose 24. If ink is ejected from the recording head, so that the ink in the sub-tank 20 is consumed, the ink in the ink tank 30 is supplied to the sub-tank 20 through the hose 24. In this way, the liquid ejecting system 1 can continue printing continuously without an interruption operation of the printer 12. The hose 24 is formed of a member having elasticity, such as synthetic rubber. In addition, it is also acceptable to directly supply ink from the ink tank 30 to the recording head through the hose 24 without providing the sub-tank 20.

Figure 2:
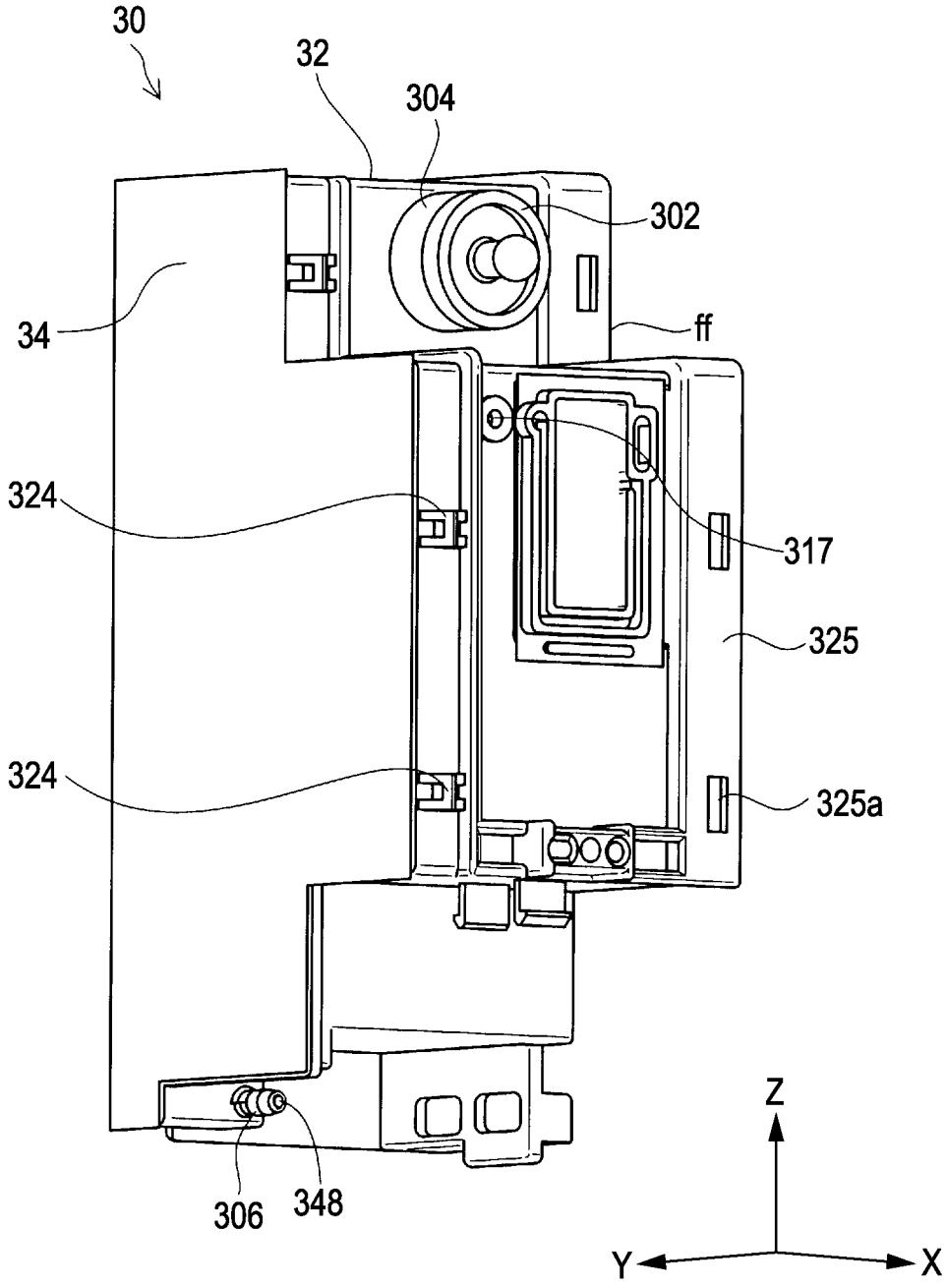
FIG. 2 is an exterior perspective view of an ink tank.

FIG. 2 is an exterior perspective view of the ink tank 30. The ink tank 30 includes a tank main body 32 and a film 34. The tank main body 32 has a concave shape and one face thereof is opened. The film 34 is adhered to the tank main body 32 so as to block an opening of the tank main body 32 in order to secure the airtightness of the inside of the tank main body 32. In the ink tank 30, the film 34 and a facing wall surface portion ff of the tank main body 32 facing the film 34 have approximately the same shape. That is, the ink tank 30 has a polygonal column shape with the film 34 and the facing wall surface portion ff as a bottom. In addition, the details of the tank main body 32 will be described later.

The ink tank 30 further has a plug member 302. The plug member 302 is mounted in a liquid injection port 304. The plug member 302 can be removed from the liquid injection port 304, and by removing it, it is possible to inject (replenish) ink from the liquid injection port 304 into the ink tank 30.

Further, the ink tank 30 has a first fitting portion 324 and a second fitting portion 325. The first fitting portion 324 has a projection shape. The second fitting portion 325 has a through-hole 325*a*. The ink tanks 30 adjacent to each other are connected (stacked) to each other using the first and second fitting portions 324 and 325. That is, the ink tanks 30 adjacent to each other are connected to each other such that the film 34 is covered by the facing wall surface portion ff of the adjacent ink tank 30. In this way, since the film 34 of any one ink tank 30 can be protected by the facing wall surface portion ff of the other adjacent ink tank 30, the tank unit 50 in which a plurality of ink tanks 30 is combined while compactifying it can be formed.

Further, the ink tank 30 has an air introduction port 317 and a liquid lead-out portion 306. The air introduction port 317 is one end portion of a flow path opened to the air for introducing external air into the ink tank 30. The liquid lead-out portion 306 is tubular and has one end portion disposed in a liquid accommodating chamber 340 of the ink tank 30 and the other end portion 348 opened toward the outside. That is, in the liquid lead-out portion 306, a lead-out flow path that makes the ink in the liquid accommodating chamber 340 flow toward the outside is formed in the inside thereof. The liquid lead-out portion 306 is connected to the hose 24 (FIG. 1B), so that the ink in the ink tank 30 flows toward the printer 12 side through the hose 24.

Figure 3:
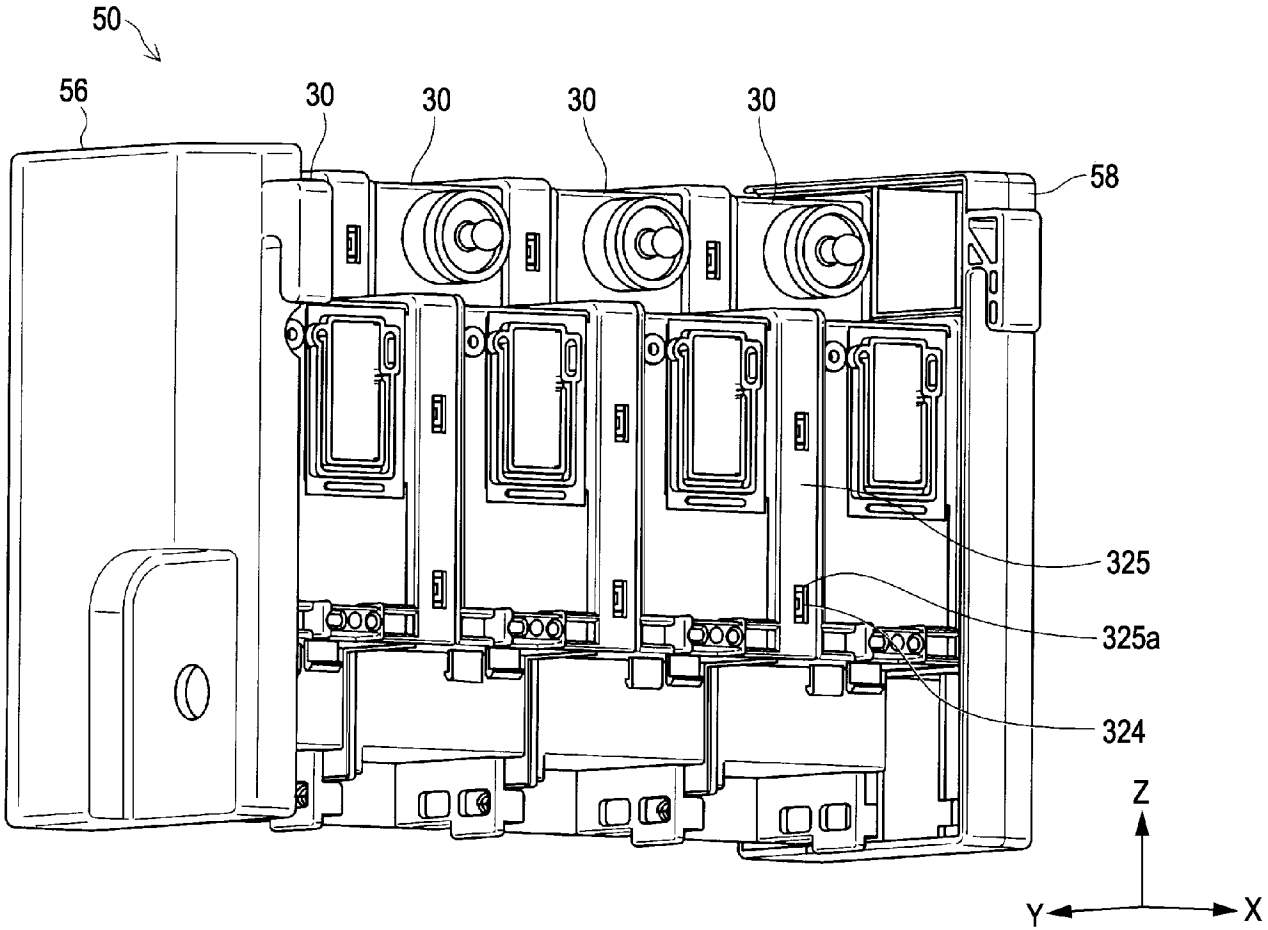
FIG. 3 is a diagram for further describing the ink tank.

FIG. 3 is a diagram for further describing the ink tank 30. FIG. 3 is a perspective view of the tank unit 50 and in order to facilitate explanation, illustration of the top case 54 (FIG. 1A) is omitted. The through-hole 325*a* of the second fitting portion 325 and the first fitting portion 324 of the ink tanks 30 adjacent to each other are fitted to each other, whereby the ink tanks 30 adjacent to each other are connected to each other. In the ink tank 30 (the ink tank 30 on the Y-axis positive direction side) in which the film 34 is exposed to the outside, among the ink tanks 30 of both ends, the film 34 is covered by the first side case 56. In this way, the film 34 is protected, so that leakage of ink to the outside due to breakage of the film 34 by impact from the outside can be prevented. It is possible to newly add the ink tank 30 to the tank unit 50 or remove the ink tank 30 from the tank unit 50 in accordance with the number of colors of ink that the printer 12 ejects. In the use position of the ink tank 30 when supplying the ink in the ink tank 30 to the printer 12 side, the Z-axis negative direction becomes a vertically downward direction and the Z-axis positive direction becomes a vertically upward direction.

A-2. Detailed Configuration of Ink Tank 30

Figure 4:
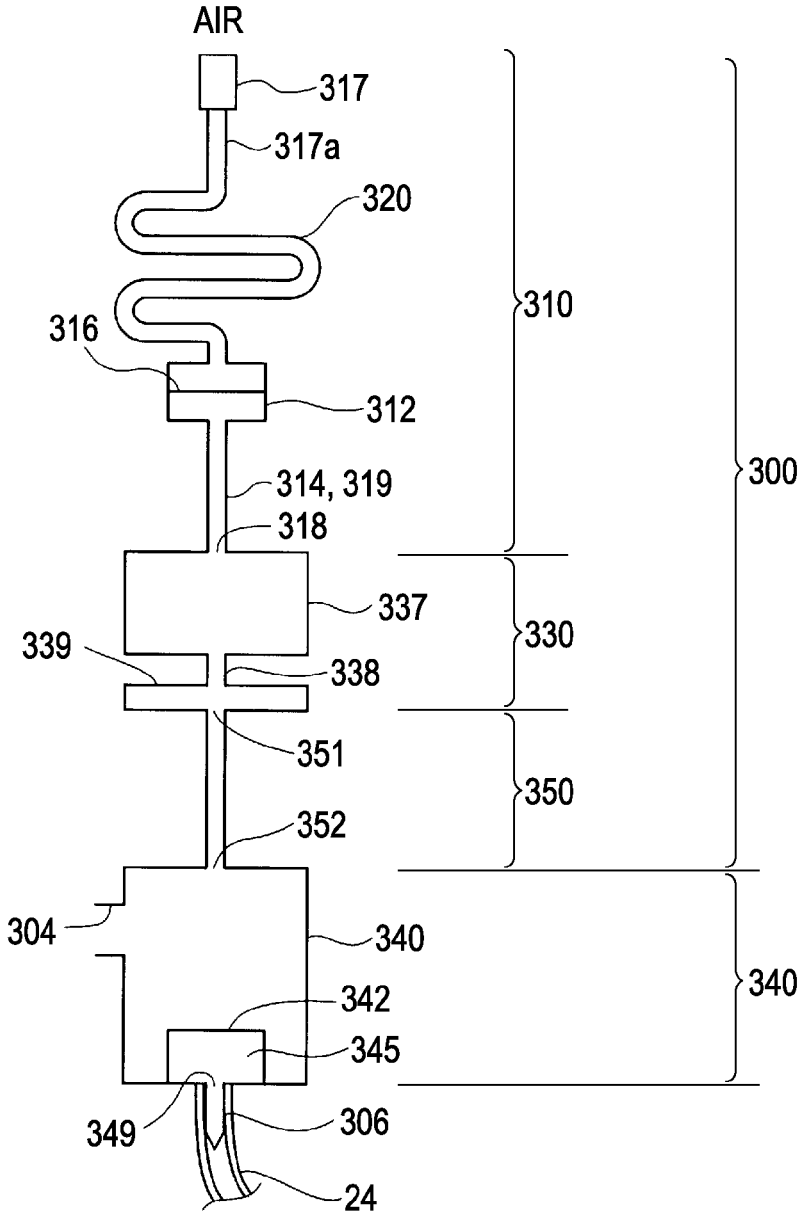
FIG. 4 is a diagram conceptually illustrating a path ranging from an air introduction port to a liquid lead-out portion.

Before explanation of the detailed configuration of the ink tank 30, in order to facilitate understanding, a path ranging from the air introduction port 317 to the liquid lead-our portion 306 will be conceptually described with reference to FIG. 4. FIG. 4 is a diagram conceptually illustrating a path ranging from the air introduction port 317 to the liquid lead-out portion 306.

The path ranging from the air introduction port 317 to the liquid lead-out portion 306 can be broadly divided into a flow path opened to the air 300 and the liquid accommodating chamber 340. The flow path opened to the air 300 is constituted by a first flow path 310, an air accommodating chamber 330, and a second flow path 350 in order from the upstream.

In the first flow path 310, a port opened to the air 318 that is one end portion thereof is opened in the air accommodating chamber 330 and the air introduction port 317 that is the other end portion is opened toward the outside, whereby the air accommodating chamber 330 is made to communicate with the outside. The first flow path 310 includes communication flow paths 317*a* and 320, a gas-liquid separation chamber 312, and communication flow paths 314 and 319. The communication flow path 317*a* communicates at one end portion thereof with the air introduction port 317 and at the other end portion with the communication flow path 320. The communication flow path 320 communicates at one end portion thereof with the communication flow path 317*a* and at the other end portion with the gas-liquid separation chamber 312. The communication flow path 320 is a long and thin flow path and suppresses evaporation of moisture of the ink retained in the liquid accommodating chamber 340 from the flow path opened to the air 300 by diffusion. A sheet member 316 is disposed between the upstream and the downstream of the gas-liquid separation chamber 312. The sheet member 316 has a gas permeable and liquid impermeable property. By disposing the sheet member 316 along the flow path opened to the air 300, inflow further to the upstream side than the sheet member 316 of ink flowed back from the liquid accommodating chamber 340 is suppressed. In addition, once the sheet member 316 is wet with ink, the sheet member 316 loses its original function as a gas-liquid separation membrane, so that there is a case where air becomes impermeable. Therefore, as will be described later, in this example, the ink tank 30 in which the possibility of back-flow of ink is reduced is provided in the first flow path 310 that is the upstream side further than the air accommodating chamber 330.

The communication flow paths 319 and 314 make the gas-liquid separation chamber 312 communicate with the air accommodating chamber 330. Here, one end portion of the communication flow path 314 is the port opened to the air 318.

The air accommodating chamber 330 has an upper accommodating chamber 337, a communication flow path 338, and a lower accommodating chamber 339 in order from the upstream side. The air accommodating chamber 330 has a flow path cross-sectional area larger than the second flow path 350 and given volume. Accordingly, the ink flowed back from the liquid accommodating chamber 340 is retained therein, so that inflow of ink further to the upstream side than the air accommodating chamber 330 can be suppressed.

The second flow path 350 has one end portion 351 opened in the air accommodating chamber 330 and the other end portion 352 opened in the liquid accommodating chamber 340, thereby making the air accommodating chamber 330 communicate with the liquid accommodating chamber 340. Further, the second flow path 350 is made to be a flow path in which a flow path cross-sectional area is small to the extent capable of forming a meniscus (liquid surface bridge).

The liquid accommodating chamber 340 accommodates ink and makes ink flow from a liquid outlet 349 of the liquid introduction portion 306 to the sub-tank 20 through the hose 24. The liquid accommodating chamber 340 has a liquid holding portion 345. The liquid holding portion 345 has a partition wall 342. The partition wall 342 intercepts flow of ink in a given direction in the liquid accommodating chamber 340, thereby suppressing outflow of ink from the liquid holding portion 345 to another portion of the liquid accommodating chamber 340. Further, as described above, the liquid injection port 304 is provided at the liquid accommodating chamber 340, so that a user can easily inject (replenish) ink from the liquid injection port 304 into the liquid accommodating chamber 340.

Figure 5:
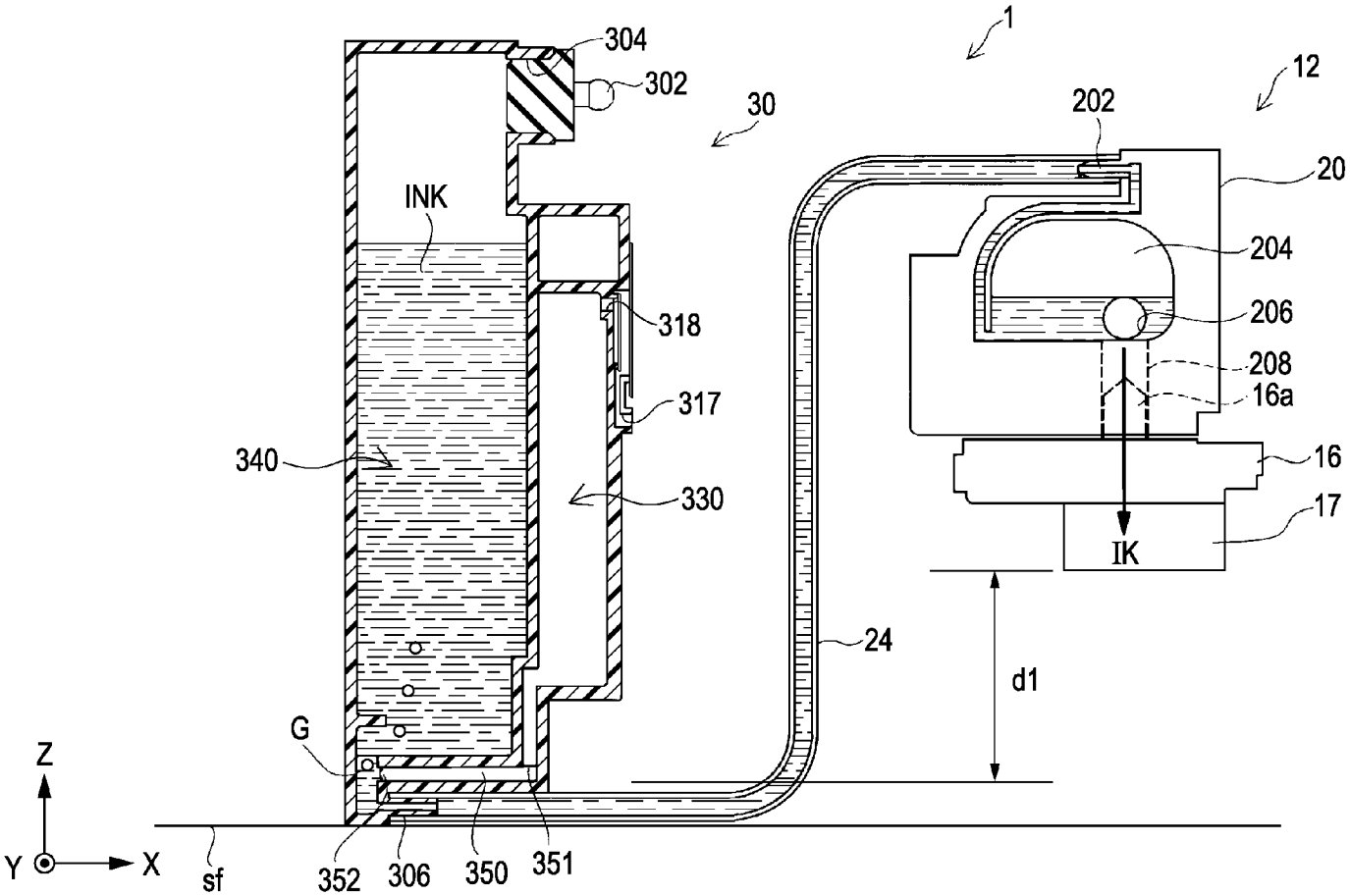
FIG. 5 is a diagram for describing ink supply.

In order to further facilitate understanding, a state where the ink tank 30 supplies ink to the sub-tank 20 is described using FIG. 5. FIG. 5 is a diagram for describing ink supply from the ink tank 30 to the sub-tank 20. FIG. 5 schematically illustrates the states of the insides of the ink tank 30, the hose 24, and the printer 12.

The liquid ejecting system 1 is installed on a given horizontal surface sf. The liquid lead-out portion 306 of the ink tank 30 and a liquid receiving portion 202 of the sub-tank 20 are connected to each other through the hose 24. The sub-tank 20 is molded by synthetic resin such as polystyrene or polyethylene. The sub-tank 20 includes an ink retention chamber 204, an ink flowing path 208, and a filter 206. In the ink flowing path 208, an ink supply needle 16*a* of the carriage 16 remains inserted. In a case where impurities such as foreign matter are mixed in ink, the filter 206 captures the impurities, thereby preventing inflow of the impurities to a recording head 17. The ink in the ink retention chamber 204 flows through the ink flowing path 208 and the ink supply needle 16*a* by suction from the recording head 17, thereby being supplied to the recording head 17. The ink supplied to the recording head 17 is ejected toward the outside (the printing paper) through the nozzle.

In addition, in the injection position when injecting ink into the ink tank 30, the ink tank 30 is installed on the given horizontal surface sf such that the X-axis negative direction becomes a vertically downward direction. After ink is injected from the liquid injection port 304 into the liquid accommodating chamber 340 in the injection position, in a case where the liquid injection port 304 is hermetically sealed by the plug member 302, whereby a use position is made, air in the liquid accommodating chamber 340 expands, so that the liquid accommodating chamber 340 is maintained at negative pressure. Further, the air accommodating chamber 330 communicates with the port opened to the air 318, thereby being maintained at the atmospheric pressure.

In the use position, the second flow path 350 which forms a meniscus is disposed so as to be located at a position lower than the recording head 17. Accordingly, a water head difference d1 is generated. In addition, the water head difference d1 in a state where a meniscus is formed in the second flow path 350 in the use position is also called a "stationary time water head difference d1".

The ink in the ink retention chamber 204 is suctioned by the recording head 17, whereby the ink retention chamber 204 becomes equal to or more than given negative pressure. If the ink retention chamber 204 becomes equal to or more than given negative pressure, the ink in the liquid accommodating chamber 340 is supplied to the ink retention chamber 204 through the hose 24. That is, ink corresponding to an amount flowed out to the recording head 17 is automatically replenished from the liquid accommodating chamber 340 to the ink retention chamber 204. In other words, suction power (negative pressure) from the printer 12 side becomes larger than the water head difference d1 which is generated by a difference in vertical height between an ink liquid surface contacting with the air accommodating chamber 330 in the ink tank 30 and the recording head (specifically, the nozzle), whereby ink is supplied from the liquid accommodating chamber 340 to the ink retention chamber 204.

If the ink in the liquid accommodating chamber 340 is consumed, air G (also referred to as an "air bubble G") in the air accommodating chamber 330 is introduced into the liquid accommodating chamber 340 through the communication portion 350. Accordingly, the liquid surface in the liquid accommodating chamber 340 is lowered.

Figure 6:
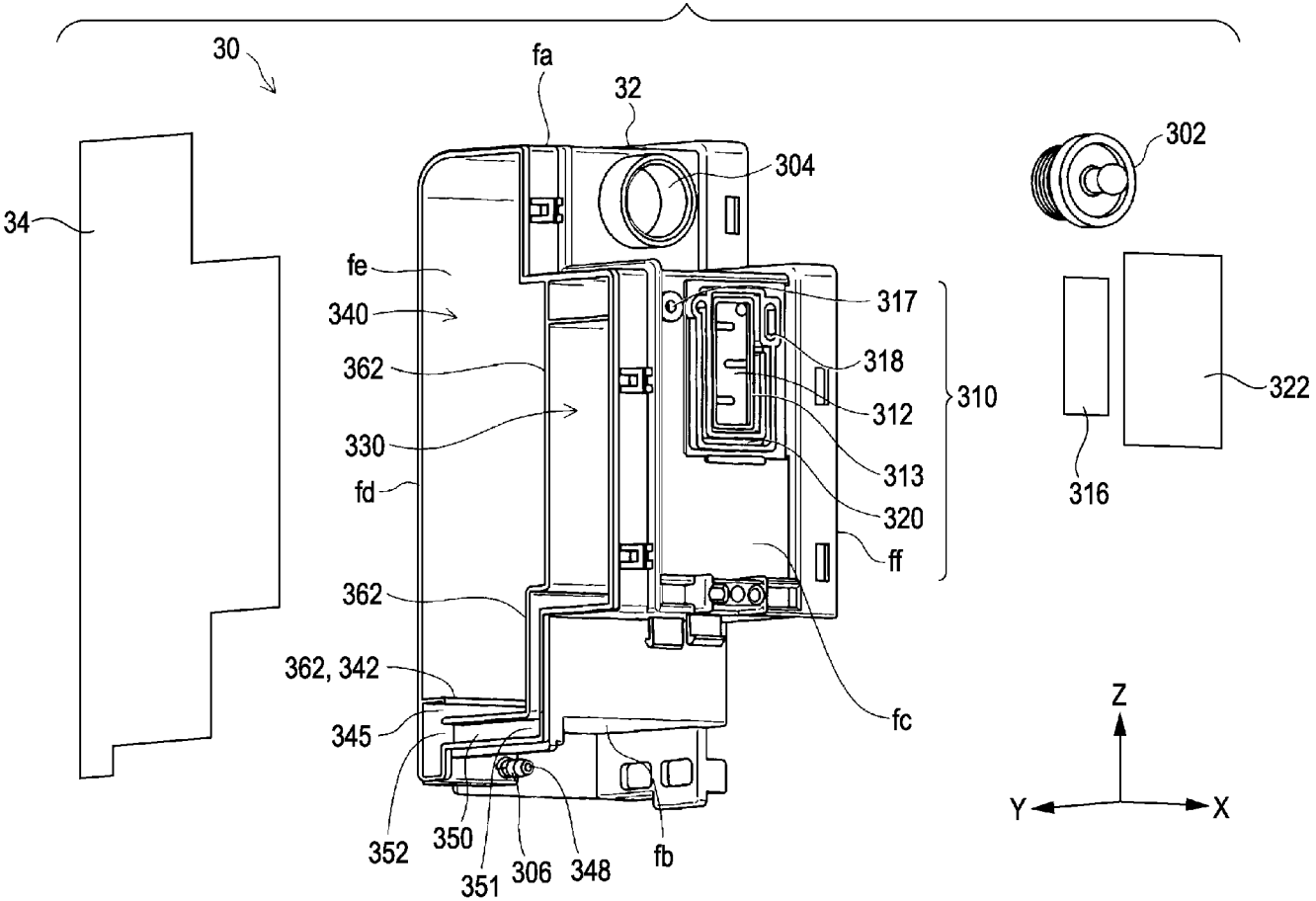
FIG. 6 is an exploded perspective view of the ink tank.
Figure 7:
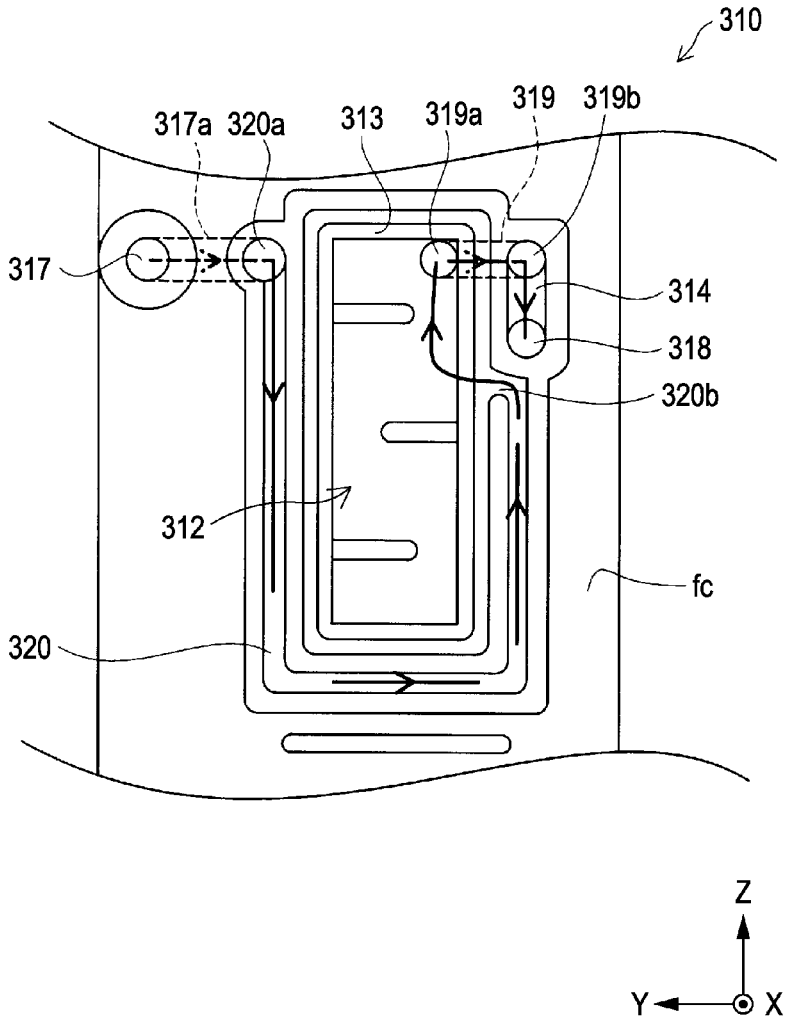
FIG. 7 is a diagram for describing a first flow path.
Figure 8:
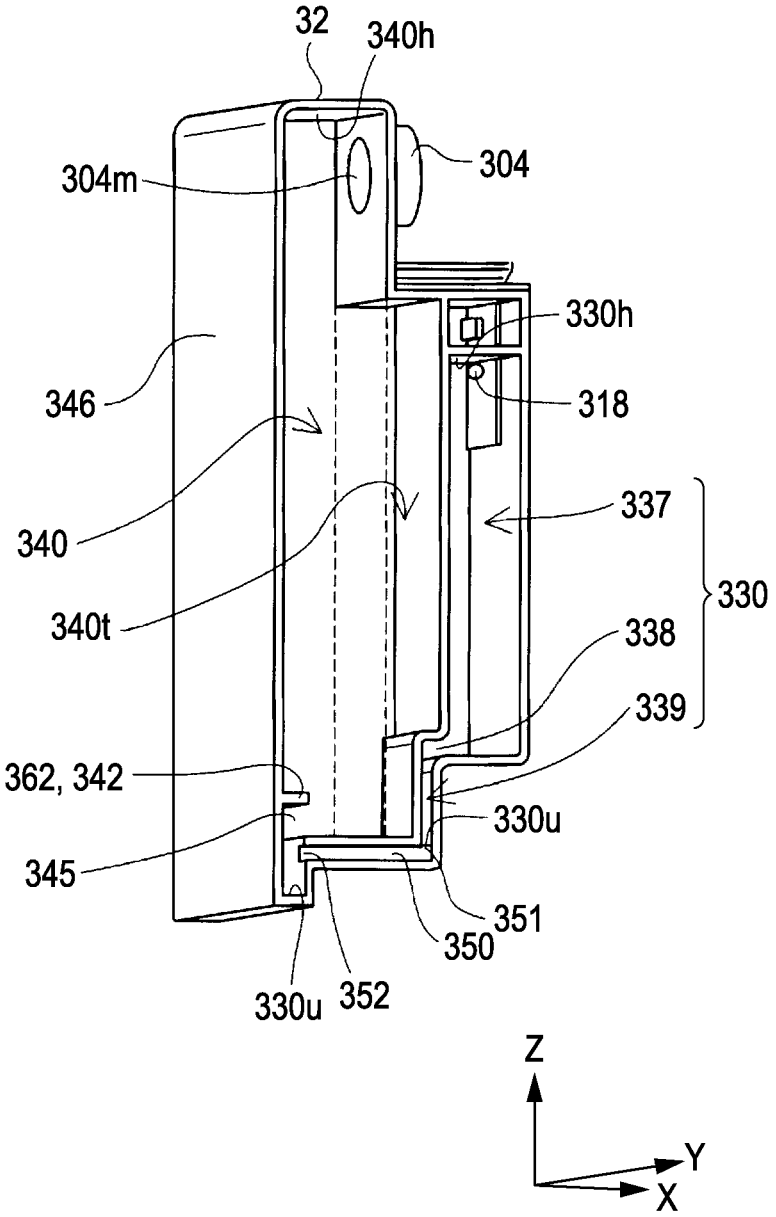
FIG. 8 is a perspective view of a tank main body.

Based on the above, the detailed configuration of the ink tank 30 will be described with reference to FIGS. 6 to 8. FIG. 6 is an exploded perspective view of the ink tank 30. FIG. 7 is a diagram for describing the first flow path 310. FIG. 8 is a perspective view of the tank main body 32. In addition, FIG. 7 is a diagram illustrating the first flow path 310 when FIG. 6 is viewed from the X-axis positive direction side, and flow of air from the air introduction port 317 to the port opened to the air 318 is schematically shown by an arrow. In addition, FIG. 7 omits illustration of the sheet members 316 and 322.

As shown in FIG. 6, the ink tank 30 is provided with the tank main body 32, the plug member 302, and a plurality of sheet members 34, 316, and 322 (also referred to as the "films 34, 316, and 322"). The tank main body 32 is molded by synthetic resin such as polypropylene. Further, the tank main body 32 is translucent, so that the amount of ink in the inside can be confirmed from the outside. The shape of the tank main body 32 is a concave shape in which one side face is opened. Ribs 362 having various shapes are formed at a concave portion of the tank main body 32. In addition, for convenience sake of explanation, with regard to the tank main body 32, a face on the Z-axis positive direction side is set to be a top face fa and a face on the Z-axis negative direction side is set to be a bottom face fb. Further, with regard to four side faces of the tank main body 32 in the use position, a face on the X-axis positive direction side is set to be a right side face fc, a face on the X-axis negative direction side is set to be a left side face fd, a face (that is, a face in which an opening is formed) of the Y-axis positive direction side is set to be a front face fe, and a face on the Y-axis negative direction side is set to be a rear face ff. Further, for convenience sake of explanation, in the use position, the X-axis direction (a direction in which the left side face fd and the right side face fc face each other) is set to be a width direction, the Y-axis direction (a direction in which the front face fe and the rear face ff face each other) is set to be a depth direction, and the Z-axis direction (the vertical direction) is set to be a height direction.

The film 34 is tightly adhered to the end surfaces of the ribs 362 and the end surface of an outer frame of the tank main body 32 such that a clearance is not formed. In this way, a plurality of small rooms is formed. Specifically, mainly, the air accommodating chamber 330, the liquid accommodating chamber 340, the communication portion 350 that is the second flow path, and the liquid holding portion 345 that is one portion of the liquid accommodating chamber 340 are formed. That is, rather than welding the same member (synthetic resin) as the tank main body 32 to the end surfaces of the ribs 362 and the end surface of the outer frame of the tank main body 32, by using the film 34, adhesion to the tank main body 32 can be performed such that a clearance is not formed. That is, by using the film 34, the airtightness of the inside of the ink tank 30 can be easily secured. On the other hand, protection of the film 34 from external impact is performed by the first side case 56 (FIG. 3) or the facing wall surface portion ff (FIG. 6) of the adjacent ink tank 30. In addition, the details of each of these rooms (each configuration) will be described later.

In the right side face fc of the tank main body 32, the liquid injection port 304 is provided. That is, the liquid injection port 304 is provided in a wall surface on the side where the air accommodating chamber 330 is disposed with respect to the liquid accommodating chamber 340, among wall surfaces partitioning and forming the liquid accommodating chamber 340. In the injection position of the ink tank 30 when injecting ink from the liquid injection port 304 into the liquid accommodating chamber 340, the right side face fc becomes a top face. That is, in the injection position, the air accommodating chamber 330 is located above the liquid accommodating chamber 340.

Further, in the right side face fc, the first flow path 310 is formed. The first flow path 310 makes air taken from the air introduction port 317 flow to the air accommodating chamber 330 through the port opened to the air 318. Here, the detailed configuration of the first flow path 310 is described using FIG. 7.

As shown in FIG. 7, in the right side face fc, the air introduction port 317, the communication flow paths 317*a* and 320, the gas-liquid separation chamber 312, the communication flow paths 319 and 314, and the port opened to the air 318 are formed. Of these, the communication flow paths 317*a* and 319 are formed in the back face (the inside of the tank main body 32) of the right side face fc.

The shape of the gas-liquid separation chamber 312 is a concave shape and a communication port 319*a* that is one end portion of the communication flow path 319 is formed in a concave bottom surface. The port opened to the air 318 communicates with the air accommodating chamber 330, thereby introducing external air into the air accommodating chamber 330.

A bank 313 is formed at the entire periphery of an inner wall surrounding the bottom surface of the gas-liquid separation chamber 312. The sheet member 316 (FIG. 6) is adhered to the bank 313. The sheet member 316 has a gas permeable and liquid impermeable property. The film 322 (FIG. 6) is adhered to the right side face fc so as to cover the communication flow path 320, the gas-liquid separation chamber 312, the communication flow path 314, and the communication ports 318, 319*a*, and 319*b*. In this way, the communication flow paths 314 and 320 are formed and also, leakage of the ink in the ink tank 30 to the outside is prevented.

The air introduction port 317 and the communication flow path 320 communicate with each other through one end portion 320*a* of the communication flow path 320 and the communication flow path 317*a* formed inside the tank main body 32. The communication flow path 320 and the gas-liquid separation chamber 312 communicate with each other through the other end portion 320*b* of the communication flow path 320. The communication flow path 320 is formed along the outer periphery of the gas-liquid separation chamber 312 in order to lengthen the distance from the air introduction port 317 to the gas-liquid separation chamber 312. Accordingly, evaporation of moisture in the ink in the tank main body 32 from the air introduction port 317 to the outside can be suppressed. In addition, from the viewpoint of moisture evaporation suppression, the communication flow path 320 may also be made to be a serpentine flow path in order to lengthen the distance of the communication flow path.

Air that flows to the other end portion 320*b*, the gas-liquid separation chamber 312, and the communication port 319*a* passes through the sheet member 316 (FIG. 6) adhered to the bank 313 on the way. The gas-liquid separation chamber 312 and the communication flow path 314 communicate with each other through the communication ports 319*a* and 319*b* and the communication flow path 319 formed in the inside of the tank main body 32. The communication flow path 314 communicates with the air accommodating chamber 330 through the port opened to the air 318. As can also be understood from the above explanation, the sheet member 316 (FIG. 6) divides the port opened to the air 318 from the outside. Accordingly, leakage of ink which is contained in the tank main body 32 to the outside can be suppressed.

As shown in FIG. 8, the air accommodating chamber 330 has a prismatic shape. In the use position, the outer shape of an uppermost surface 330*h* which is located at the vertically uppermost side, among inner faces partitioning and forming the air accommodating chamber 330, and the outer shape of a lowermost surface 330*u* which is located at the vertically lowermost side are rectangular. Further, the air accommodating chamber 330 has the upper accommodating chamber 337 of an approximately rectangular parallelepiped shape which includes the uppermost surface 330*h*, the lower accommodating chamber 339 of an approximately rectangular parallelepiped shape which includes the lowermost surface 330*u*, and the communication flow path 338 which makes the upper accommodating chamber 337 and the lower accommodating chamber 339 communicate with each other. The port opened to the air 318 is disposed at a position that is close to the uppermost surface 330*h* and is included in a corner portion of the upper accommodating chamber 337. In addition, the details of the corner portion will be described later.

In the second flow path 350, compared to the liquid accommodating chamber 340 or the air accommodating chamber 330, a length in the depth direction (the Y-axis direction) is small and a length in the height direction (the Z-axis direction) is also small. That is, the second flow path 350 has a flow path cross-sectional area which is small to the extent that a meniscus can be formed. The air-side opening 351 of the second flow path 350 is disposed in the air accommodating chamber 330 and the liquid-side opening 352 is disposed in the liquid accommodating chamber 340.

The liquid accommodating chamber 340 has a prismatic shape. The liquid accommodating chamber 340 has the liquid holding portion 345 and an air retention portion 340*t*. In the use position, the outer shape of an uppermost surface 340*h* which is located at the vertically uppermost side, among inner faces partitioning and forming the liquid accommodating chamber 340, and the outer shape of a lowermost surface 330*u* which is located at the vertically lowermost side are rectangular. The air retention portion 340*t* is a portion occupying a higher position than an opening 304*m* on the liquid accommodating chamber 340 side of the liquid injection port 304, with respect to the vertical direction (the X-axis direction) in the injection position, among the portions of the liquid accommodating chamber 340. The liquid holding portion 345 is provided in the liquid accommodating chamber 340 in order to maintain the liquid surface of ink at a height equal to or more than a given height in the injection position. The liquid holding portion 345 has the partition wall 342 extending by a given length from a bottom face portion 346 (the left side face fd of the ink tank 30) in the injection position toward a facing face. The partition wall 342 is formed over the entire area in the Y-axis direction (the depth direction) at the inside of the liquid accommodating chamber 340. That is, the partition wall 342 divides the bottom face portion 346 into two areas.

A-3. Disposition Relationship Between Respective Configurations of Ink Tank

Figure 9A:
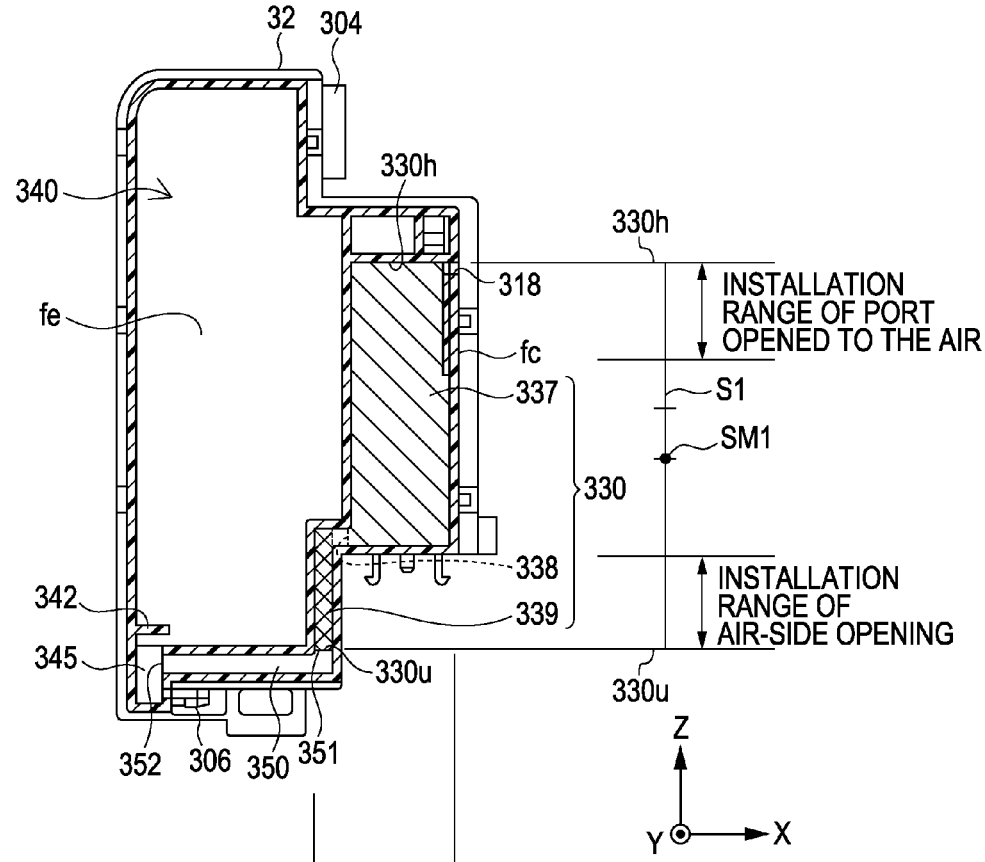
FIGS. 9A and 9B are diagrams for describing the disposition position of an air-side opening.
Figure 9B:
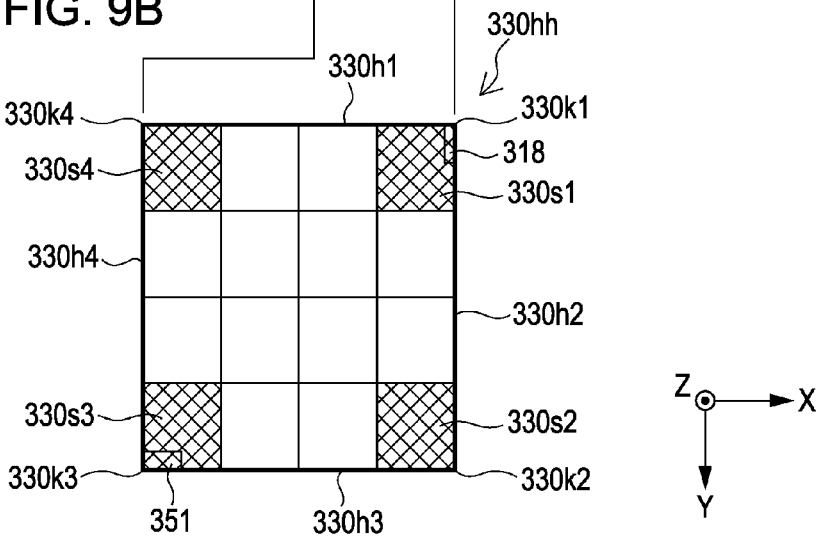

Next, a positional relationship between the respective configurations of the ink tank 30 will be described in detail. FIGS. 9A and 9B are diagrams for describing the disposition positions of the port opened to the air 318 and the air-side opening 351. FIG. 9A is a diagram when FIG. 6 is viewed from the Y-axis positive direction side, and FIG. 9B is a diagram for describing corner portions where the port opened to the air 318 and the air-side opening 351 are disposed. In addition, in FIG. 9A, in order to facilitate understanding, single hatching is imparted to the upper accommodating chamber 337 and cross-hatching is imparted to the lower accommodating chamber 339. Further, the boundary of the communication flow path 338 is shown by a dashed line. Further, in FIG. 9B, the outermost inner wall surface of the air accommodating chamber 330 in a case where the air accommodating chamber 330 is vertically projected vertically downward in the use position is shown by a thick line. Hereinafter, an area surrounded by this thick line is defined to be a vertical projection plane 330*hh* (also referred to as an "outermost frame projection plane 330*hh*"). In addition, in FIG. 9B, in order to facilitate understanding, the formation positions of the port opened to the air 318 and the air-side opening 351 are schematically shown. In addition, the outermost frame projection plane 330*hh* is defined by a rectangular shape best corresponding with an outer frame shape which is formed by connecting the lines of an outer frame when the inner wall surface of the air accommodating chamber 330 is vertically projected vertically downward. In this example, as shown in FIG. 9B, the outer frame shape shown by a thick line is a rectangular shape. Further, for example, even if a semicircular projection shape is present along a side 330*h*4 of the outer frame shape shown in FIG. 9B, the outermost frame projection plane 330*hh* is defined by a rectangular shape best corresponding with an outer frame shape which includes the projection shape.

As shown in FIG. 9A, with respect to the vertical direction of the tank main body 32 in the use position, the port opened to the air 318 is disposed at a position closer to the uppermost surface 330*h* than an air chamber middle point SM1 that is the middle point of a line segment S1 connecting the lowermost surface 330*u* and the uppermost surface 330*h* of the air accommodating chamber 330. In this example, the port opened to the air 318 is disposed close to the uppermost surface 330*h*. Further, the port opened to the air 318 is formed in the right side face fc that is a face farthest from the liquid accommodating chamber 340 among the inner wall surfaces partitioning the upper accommodating chamber 337. Further, the port opened to the air 318 is disposed at a corner portion of the air accommodating chamber 330.

Corner portions are described using FIG. 9B. Each of sides 330*h*1 to 330*h*4 of the rectangular vertical projection plane 330*hh* is quartered. If the quartered points of the respective sides facing each other are connected to each other, the vertical projection plane 330*hh* is partitioned into 16 equally-divided areas. Among the 16 equally-divided areas, the areas (area with cross-hatching imparted thereto) including corners 330*k*1 to 330*k*4 of the vertical projection plane 330*hh* becomes corner portions 330*s*1 to 330*s*4 of the air accommodating chamber 330. Here, in this example, the port opened to the air 318 is located in the area of the corner portion 330*s*1 (also referred to as a "first corner portion 330*s*1"). In this example, the port opened to the air 318 is located at a position closer to the corner 330*k*1 even in the area of the first corner portion 330*s*1.

As shown in FIG. 9A, the air-side opening 351 of the second flow path 350 is disposed at a position closer to the lowermost surface 330*u* than the air chamber middle point SM1 with respect to the vertical direction in the use position. In this example, the air-side opening 351 is disposed at the lowermost surface 330*u*.

Further, as shown in FIG. 9B, the air-side opening 351 is disposed at the corner portion 330*s*3 (also referred to as a "second corner portion 330*s*3") that is at a diagonal position to the first corner portion 330*s*1 where the port opened to the air 318 is located.

Figure 10A:
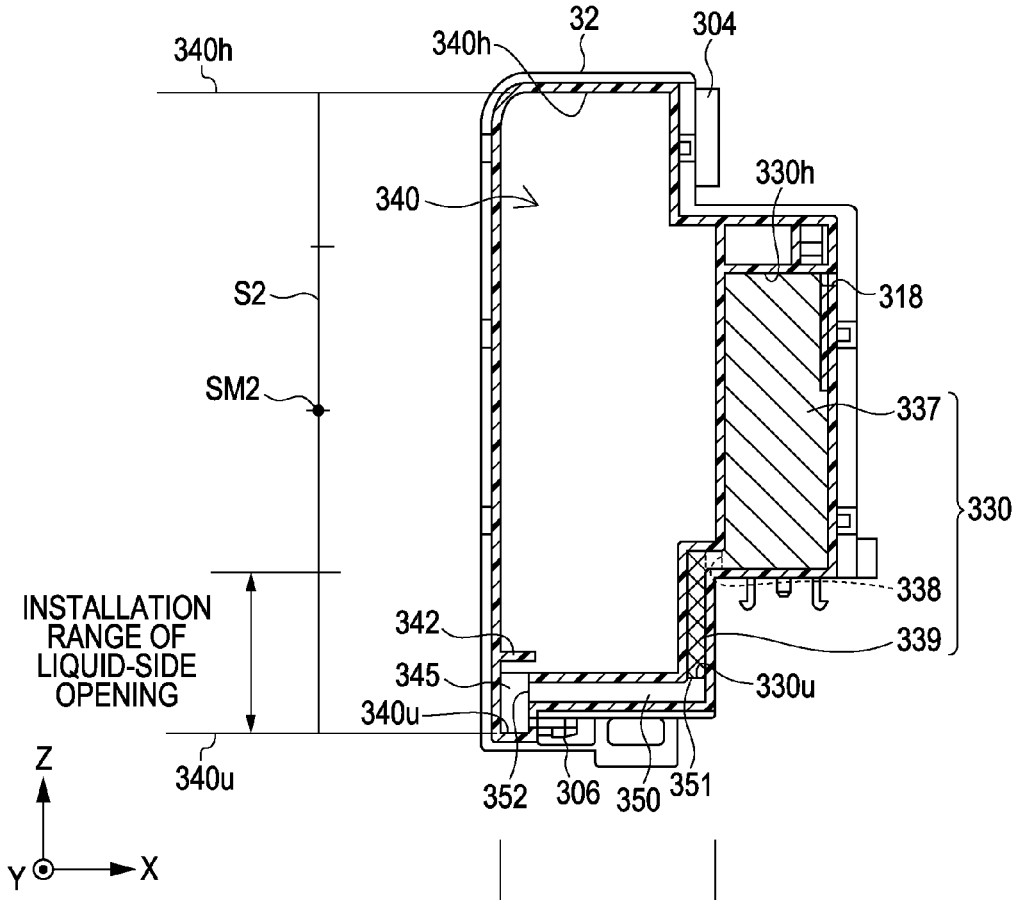
FIGS. 10A and 10B are diagrams for describing the installation position of a liquid-side opening.
Figure 10B:
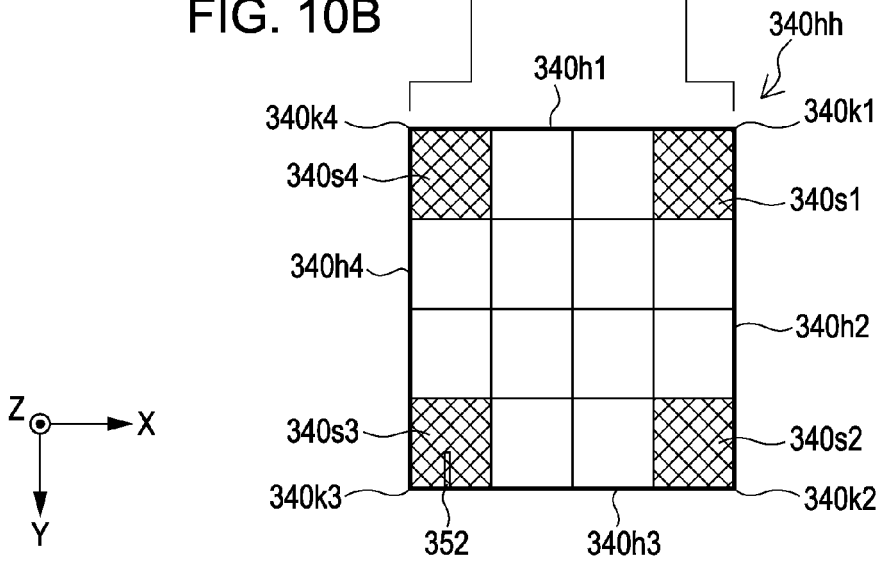

FIGS. 10A and 10B are diagrams for describing the installation position of the liquid-side opening 352. FIG. 10A is a diagram when FIG. 6 is viewed from the Y-axis positive direction side. In FIG. 10B, the outermost inner wall surface of the liquid accommodating chamber 340 in a case where the liquid accommodating chamber 340 is vertically projected vertically downward in the use position is shown by a thick line. Hereinafter, an area plane surrounded by this thick line is defined to be a vertical projection plane 340*hh* (also referred to as an "outermost frame projection plane 340*hh*"). In addition, in order to facilitate understanding, in FIG. 10B, the liquid-side opening 352 is schematically shown. In addition, the outermost frame projection plane 340*hh* is defined in the same manner as the outermost frame projection plane 330*hh*.

As shown in FIG. 10A, with respect to the vertical direction of the tank main body 32 in the use position, the liquid-side opening 352 is disposed at a position closer to the lowermost surface 340*u* than a liquid chamber middle point SM2 that is the middle point of a line segment S2 connecting the lowermost surface 340*u* and the uppermost surface 340*h* of the liquid accommodating chamber 340. In this example, the liquid-side opening 352 is disposed slightly above the liquid lead-out portion 306 which is disposed close to the lowermost surface 340*u*, with respect to the vertical direction. Further, the liquid-side opening 352 is disposed close to the film 34 (FIG. 6) that forms the front face fe among the inner wall surfaces partitioning the liquid accommodating chamber 340.

Further, as shown in FIG. 10B, the liquid-side opening 352 is disposed at a corner portion 340*s*3 (also referred to as a "third corner portion 340*s*3") that is a corner portion of the liquid accommodating chamber 340 and is at a position equivalent to a diagonal position to the corner portion 330*s*1 (FIG. 9B) of the air accommodating chamber 330, where the port opened to the air 318 is located. Here, a case where the vertical projection planes 330*hh* and 340*hh* are located in a positional relationship in which with respect to two different rectangular vertical projection planes 330*hh* and 340*hh*, one side becomes parallel to each other is considered. That is, with respect to a positional relationship between the vertical projection planes 330*hh* shown in FIG. 9B and the vertical projection planes 340*hh* shown in FIG. 10B, the corner portions 330*s*1 and 340*s*1 which are located at the upper right are equivalent to corner portions corresponding to each other. Further, the corner portions 330*s*2 and 340*s*2 which are located at the lower right are equivalent to corner portions corresponding to each other. Further, the corner portions 330*s*4 and 340*s*4 which are located at the upper left are equivalent to corner portions corresponding to each other. Further, the corner portions 330*s*3 and 340*s*3 which are located at the lower left are equivalent to corner portions corresponding to each other. In addition, the "corner portions of the liquid accommodating chamber 340" are areas (areas with cross-hatching imparted thereto) including corners 340*k*1 to 340*k*4, among of the partitioned areas obtained by partitioning the rectangular vertical projection plane 340*hh* into 16 equally-divided areas.

Figure 11A:
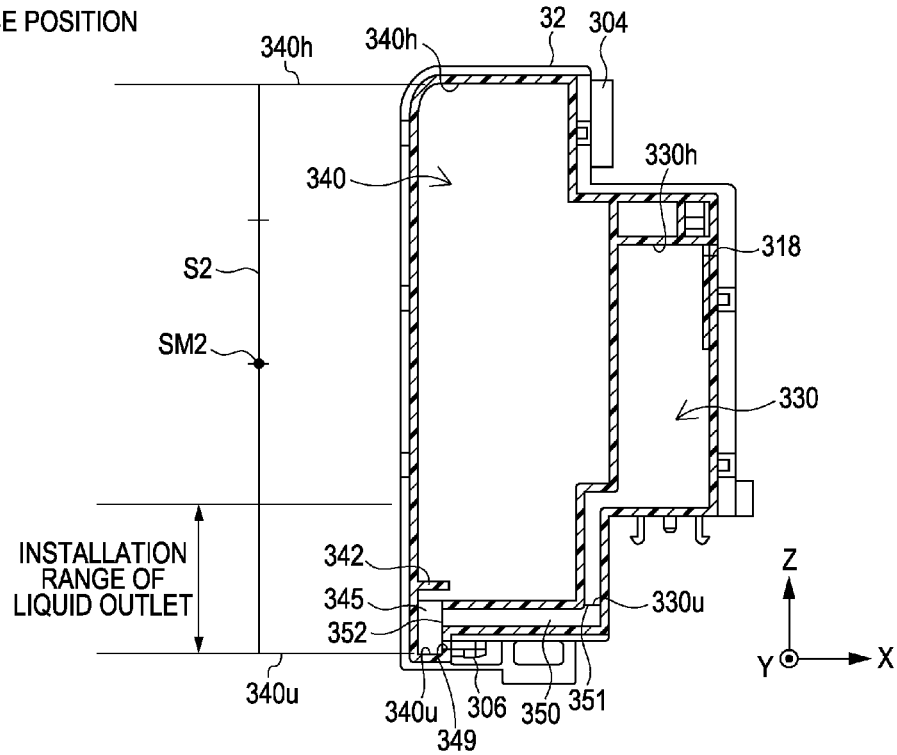
FIGS. 11A and 11B are diagrams for describing the installation position of a liquid outlet.
Figure 11B:
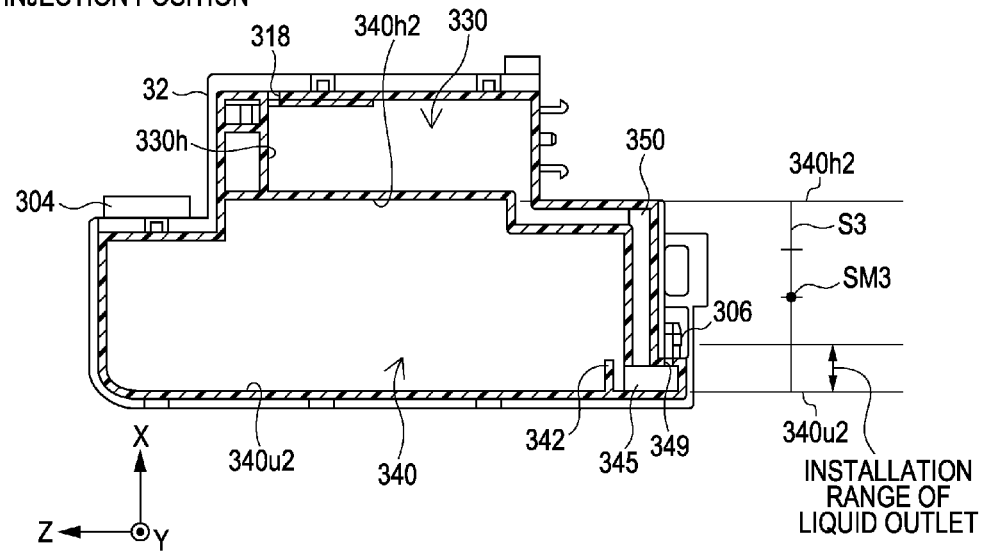

FIGS. 11A and 11B are diagrams for describing the installation position of the liquid outlet 349. FIG. 11A is a diagram when FIG. 6 is viewed from the Y-axis positive direction side. FIG. 11B is a diagram in a case where the tank main body 32 shown in FIG. 11A is made to be in an injection position. In addition, in FIGS. 11A and 11B, the disposition position in the liquid accommodating chamber 340 of the liquid outlet 349 that is one end portion of the liquid lead-out portion 306 is also shown collectively.

As shown in FIG. 11A, with respect to the vertical direction in the use position, the liquid outlet 349 is disposed at a position closer to the lowermost surface 340*u* than the liquid chamber middle point SM2 that is the middle point of the line segment S2 connecting the lowermost surface 340*u* and the uppermost surface 340*h* of the liquid accommodating chamber 340. Further, as shown in FIG. 11B, with respect to the vertical direction in the injection position, the liquid outlet 349 is disposed at a position closer to a lowermost surface 340*u*2 than a second liquid chamber middle point SM3 that is the middle point of a line segment S3 connecting the lowermost surface 340*u*2 and an uppermost surface 340*h*2 of the liquid accommodating chamber 340. In this example, the liquid outlet 349 is disposed close to at least the lowermost surface 340*u* in the use position.

In this manner, with respect to the vertical direction in the use position, the liquid outlet 349 is disposed within a given range, whereby ink can be supplied from the liquid lead-out portion 306 to the sub-tank 20 (FIG. 5) until the remaining amount of ink in the liquid accommodating chamber 340 becomes smaller. Further, with respect to the vertical direction in the injection position, the liquid outlet 349 is disposed within a given range, whereby even in a case where the injection position is made in state the remaining amount of ink in the liquid accommodating chamber 340 is a smaller amount, it becomes possible to maintain a state where the liquid surface of ink is higher than the liquid outlet 349. That is, it becomes possible to maintain a state where the liquid outlet 349 contacts with ink without intervention of air. Accordingly, when injecting ink from the liquid injection port 304, a possibility that air may flow to the recording head 17 side through the liquid outlet 349, the liquid lead-out portion 306, and the hose 24 (FIG. 5) can be reduced.

A-4. Ink Injection Method of Ink Tank

Figure 12:
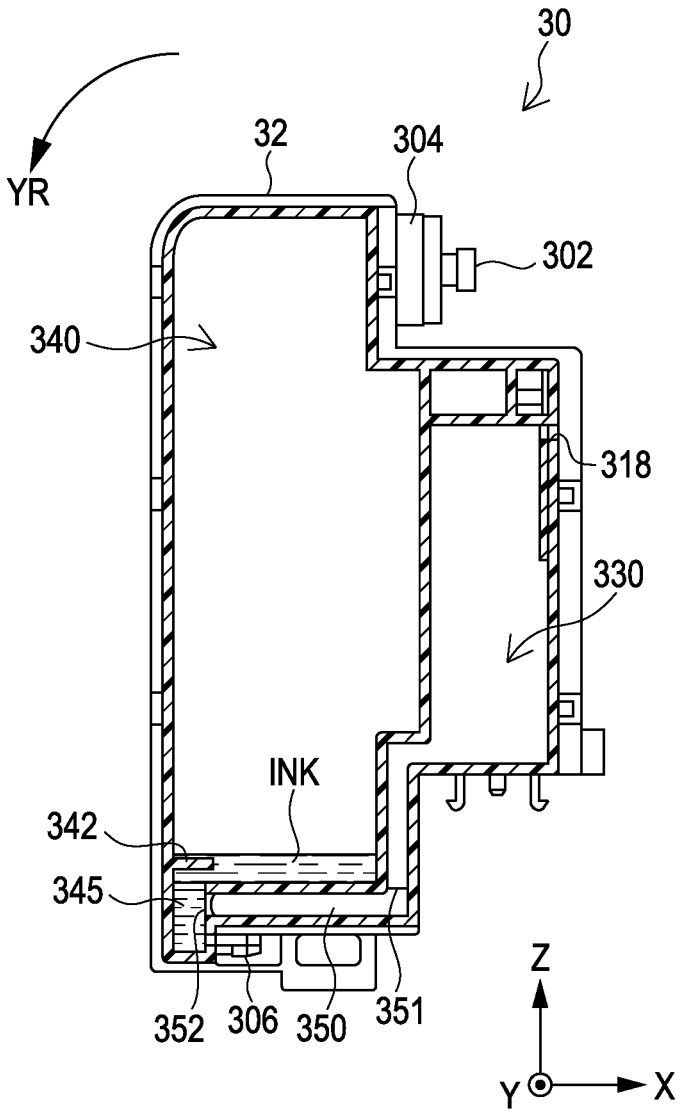
FIG. 12 is a diagram illustrating a state where the remaining amount of ink in a liquid accommodating chamber has become small.

FIG. 12 is a diagram illustrating a state where the remaining amount of ink in the liquid accommodating chamber 340 has become small. In addition, actually, the liquid lead-out portion 306 and the liquid receiving portion 202 of the sub-tank 20 are connected to each other through the hose 24. However, the illustration is omitted.

As shown in FIG. 12, if the ink in the liquid accommodating chamber 340 becomes equal to or less than a given amount, in order to prevent generation of a defect (dot omission or the like) of the printer 12, a user carries out a replenishment of ink. For example, a limit line that becomes the criterion of ink injection timing is applied to the tank main body 32 and in a case where the water level of ink falls below the limit line, a user replenishes ink. Here, it is assumed that the water level of ink falls below the limit line in the state shown in FIG. 12. When injecting ink into the liquid accommodating chamber 340, as shown by an arrow YR, the ink tank 30 is rotated such that the liquid injection port 304 faces vertically upward.

Figure 13A:
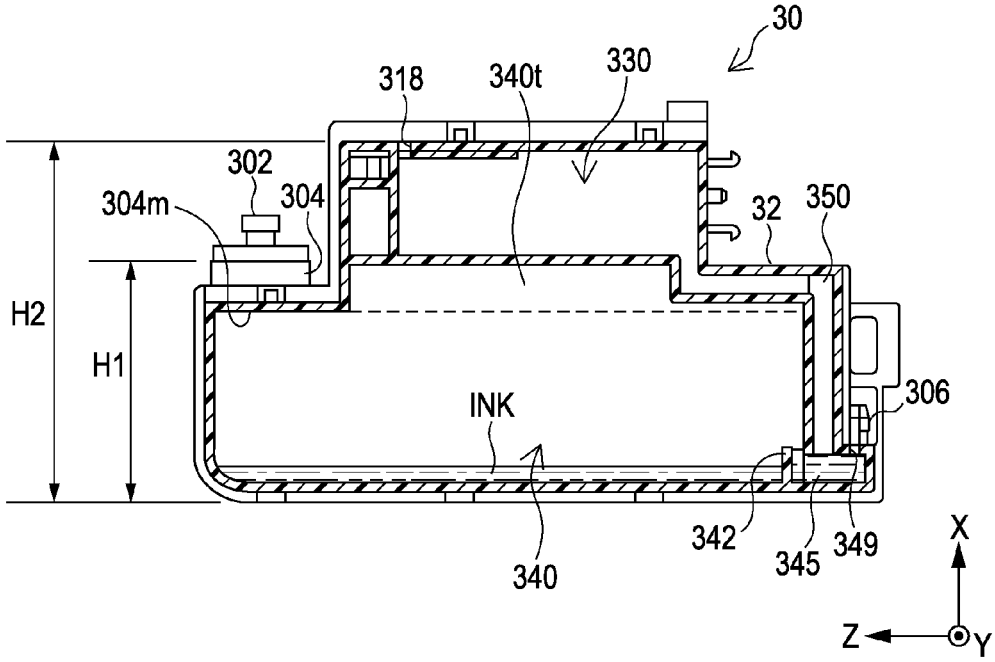
FIGS. 13A and 13B are diagrams illustrating the state of ink injection into the ink tank.
Figure 13B:
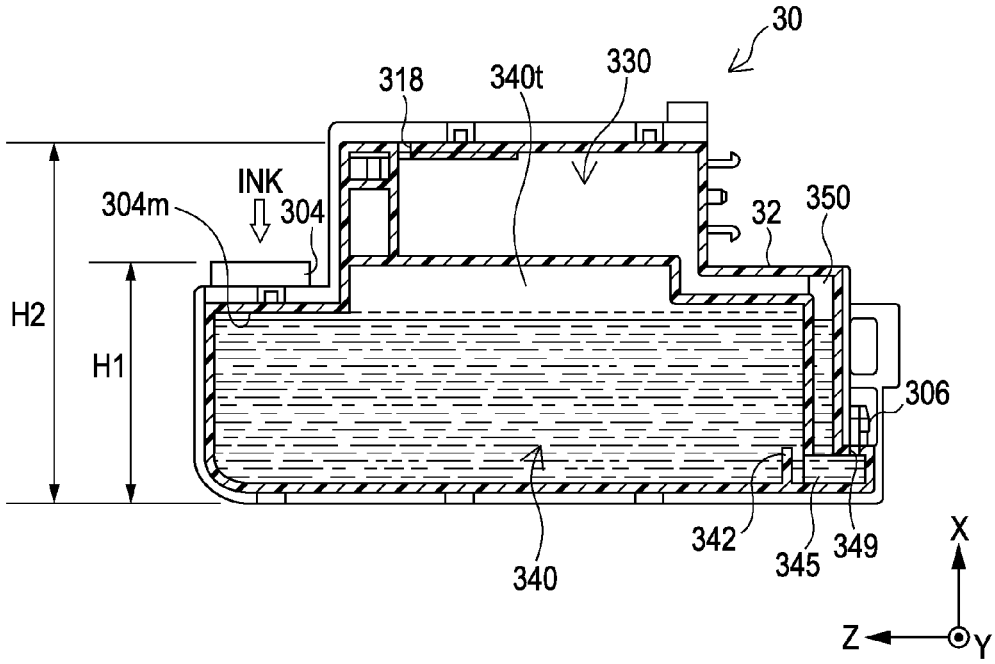

FIGS. 13A and 13B are diagrams illustrating the state of ink injection into the ink tank 30. FIG. 13A is a diagram illustrating the state of the ink in the ink tank 30 when the ink tank 30 has been changed from the use position to the injection position in a state where the remaining amount of ink shown in FIG. 12 is small. FIG. 13B is a diagram illustrating a state where a normal amount of ink has been injected into the liquid accommodating chamber 340. In addition, the expression, "injection of a normal amount of ink into the liquid accommodating chamber 340", means that ink less than a given amount remains contained in the liquid accommodating chamber 340. Specifically, it means that ink is injected into the liquid accommodating chamber 340 within the range in which the liquid surface of ink is located below the liquid injection port 304.

In the case of injecting ink into the liquid accommodating chamber 340, the plug member 302 mounted on the liquid injection port 304 is removed and ink is then injected from the liquid injection port 304. Since the liquid injection port 304 is provided in a face parallel to the vertical direction in the use position (FIG. 6), at the time of ink injection, a user changes a position into the injection position in which the liquid injection port 304 becomes vertically upward. Accordingly, it is possible to prevent ink from being injected into the liquid accommodating chamber 340 in the use position. In a case where ink is injected into the liquid accommodating chamber 340 in the use position, ink is injected in large amounts into the air accommodating chamber 330. As a result, immediately after ink injection, an ink liquid surface directly contacting with the air is formed in the air accommodating chamber 330. Accordingly, a water head difference greatly deviated from the stationary time water head difference d1 shown in FIG. 5 is generated, so that a case where it is not possible to stably supply ink from the ink tank 30 to the printer 12 side occurs.

On the other hand, in this example, in the case of performing ink injection, a user changes the position of the ink tank 30 into the injection position in which the air accommodating chamber 330 is located above the liquid accommodating chamber 340 with respect to the vertical direction. In this way, at the time of ink injection, a possibility that ink may flow into the air accommodating chamber 330 can be reduced, so that it is possible to maintain a water head difference within a given range. In addition, injection of ink is performed in a state where the ink tank 30 and the sub-tank 20 have been connected to each other by the hose 24. A meniscus (liquid surface bridge) remains formed in the nozzle of the recording head 17 (FIG. 5), so that a configuration is made such that if an external force (pressure that a piezoelectric element applies to ink) is not applied, ink is not ejected from the nozzle. That is, since the nozzle of the recording head 17 retains ink with a certain force, the ink in the liquid lead-out portion 306 communicating with the nozzle is retained in the liquid lead-out portion 306 without flowing back to the liquid accommodating chamber 340 side.

As shown in FIG. 13A, in a case where a position is changed from the use position to the injection position in a state where the remaining amount of ink is small, the liquid holding portion 345 suppresses outflow of ink to another portion of the liquid accommodating chamber 340. That is, the partition wall 342 blocks flow of ink in a direction (the Z-axis positive direction) away from the liquid outlet 349. For this reason, in the injection position, in the liquid holding portion 345, it is possible to maintain a higher water level than the other portion. More specifically, by the partition wall 342, it becomes possible to maintain a water level in the liquid holding portion 345 at a height equal to or more than the height of the liquid outlet 349. Accordingly, even in a case where the remaining amount of ink is small, the ink in the liquid lead-out portion 306 and the ink in the liquid holding portion 345 can be continuously present without intervention of air. Therefore, a possibility that at the time of the ink injection, air (air bubbles) may flow from the liquid outlet 349 into the liquid lead-out portion 306 and then flow into the sub-tank 20 through the hose 24 can be reduced. In this way, since air is not flowed into the recording head 17 (FIG. 5) side at the time of the ink injection, it is possible to suppress dot omission due to idle printing, thereby suppressing deterioration of printing quality.

As shown in FIG. 13B, in a case where a normal amount of ink has been injected into the liquid accommodating chamber 340, in the injection position, the ink liquid surface in the liquid accommodating chamber 340 is located below the liquid injection port 304. Here, since in the injection position, a height H1 of the liquid injection port 304 is lower than a height H2 of the port opened to the air 318, in a case where a normal amount of ink has been injected into the liquid accommodating chamber 340, overflow of ink from the port opened to the air 318 can be prevented. Further, even in a case where ink has been excessively injected into the liquid accommodating chamber 340 to the extent that the ink liquid surface reaches the liquid injection port 304, since the height H1 of the liquid injection port 304 is lower than the height H2 of the port opened to the air 318, overflow of ink from the port opened to the air 318 can be prevented.

Further, with respect to the vertical direction in the injection position, the liquid accommodating chamber 340 has the air retention portion 340*t* that occupies a higher position than the opening 304*m* of the liquid injection port 304 and that retains a given amount of air in the liquid accommodating chamber 340 even in a case where ink has been excessively injected into the liquid accommodating chamber 340 in the injection position. In other words, the liquid accommodating chamber 340 has the air retention portion 340*t* for retaining at least air of a given amount of volume regardless of the injection amount of ink in the injection position. That is, since the liquid accommodating chamber 340 has the air retention portion 340*t* which is located at a position equal to or more than the height of the opening 304*m* in the injection position and in which a periphery other than a vertically downward portion is surrounded by the inner wall surface of the liquid accommodating chamber 340, air equal to or more than given capacity can be retained in the liquid accommodating chamber 340. Accordingly, even in a case where the state of the ink tank 30, which will be described later, has changed, since air equal to or more than a given amount is present in the liquid accommodating chamber 340, a possibility that the ink in the liquid accommodating chamber 340 may flow out from the port opened to the air 318 toward the outside can be still further reduced.

A-5. Change in State of Ink Tank

Next, the state of the ink in the ink tank 30 in a case where the state of the ink tank has changed will be described using FIGS. 14A to 16B. In addition, FIGS. 14A to 16B illustrate by dots the state of ink when the state of the ink tank 30 has changed due to transportation or the like in a state where an appropriate amount (for example, an amount shown in FIG. 13B) of ink has been contained in the liquid accommodating chamber 340. In addition, the plug member 302 is attached to the liquid injection port 304. Accordingly, leakage of ink from the liquid injection port 304 to the outside is prevented. Further, the other end portion 348 of the liquid lead-out portion 306 is configured such that liquid is not leaked toward the outside. Specifically, the hose 24 is attached to the other end portion 348, so that the ink tank 30 is connected to the printer 12 (FIG. 1). A valve is mounted along the hose 24, so that it is possible to make the valve be in a closed state at the time of transportation or the like. If the valve enters a closed state, the internal flow path of the hose 24 is blocked. Accordingly, in a case where the state of the ink tank has changed due to transportation or the like, flow of ink from the ink tank 30 to the printer 12 side through the hose 24 is prevented.

Figure 14B:
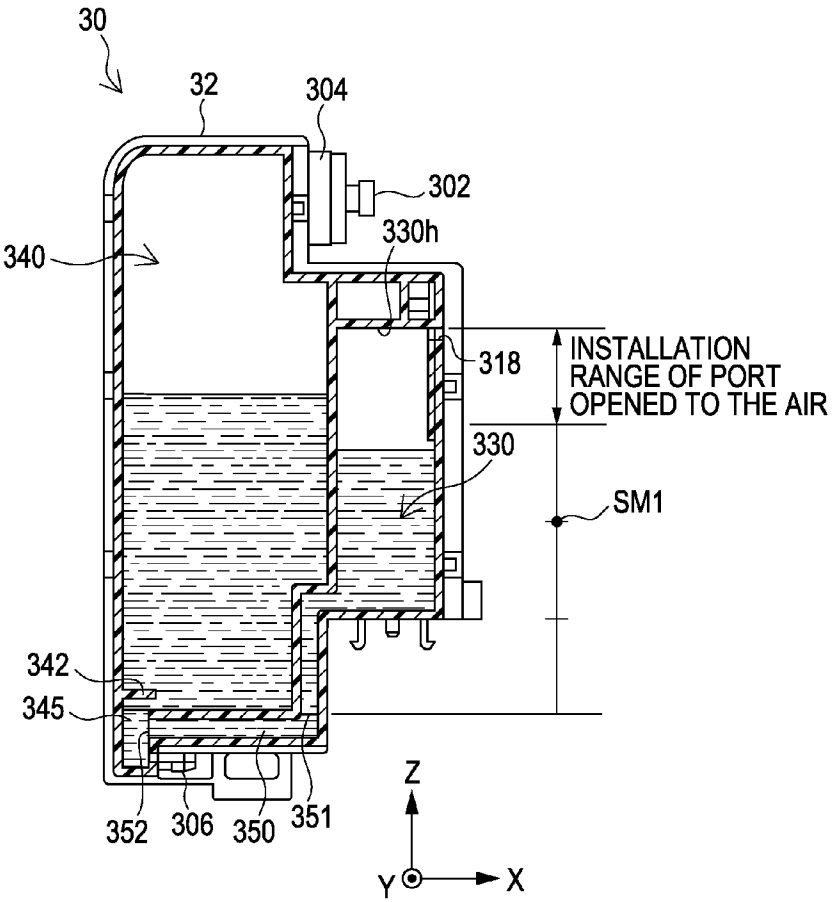
FIGS. 14A and 14B are diagrams for describing the state of ink in a use position.
Figure 14A:
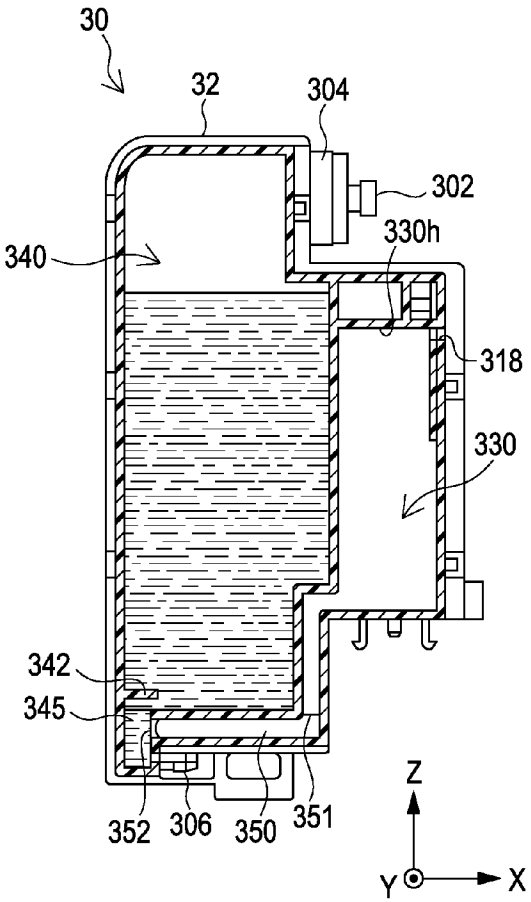

FIGS. 14A and 14B are diagrams for describing the state of ink in the use position. FIG. 14A shows the state of the ink of the inside of the ink tank 30 in a case where the ink tank 30 is exposed to low temperature environment in the use position. FIG. 14B shows the state of the ink of the inside of the ink tank 30 in a case where the ink tank 30 is exposed to high temperature environment in the use position. Here, the term, low temperature environment, refers to, for example, environment in which the temperature around the ink tank 30 is in the range of −20° C. to 20° C., and the term, high temperature environment, refers to, for example, environment in which the temperature around the ink tank 30 is a higher temperature (20° C. to 60° C.) than the low temperature environment.

As shown in FIG. 14A, in the low temperature environment, a meniscus remains formed in the second flow path 350. Here, FIG. 14A shows a state where after an appropriate amount of ink is injected from the liquid injection port 304 into the liquid accommodating chamber 340 in the injection position, the liquid injection port 304 is sealed by the plug member 302 and the use position is then made. That is, if a position is changed from the injection position to the use position, air in the liquid accommodating chamber 340 expands, so that the liquid accommodating chamber 340 is maintained at negative pressure. On the other hand, the air accommodating chamber 330 communicates with the port opened to the air 318, thereby being maintained at the atmospheric pressure. Accordingly, when a difference between the pressure of air that is present in the liquid accommodating chamber 340 and the pressure of air that is present in the air accommodating chamber 330 is within a given range, the ink in the liquid accommodating chamber 340 does not flow into the air accommodating chamber 330, as shown in FIG. 14A.

As shown in FIG. 14B, if the environment to which the ink tank 30 is exposed changes from the low temperature environment to the high temperature environment, air in the liquid accommodating chamber 340 expands. Then, the ink in the liquid accommodating chamber 340 is extruded due to expansion of air, so that some of the ink flows into the second flow path 350 and the air accommodating chamber 330. However, the port opened to the air 318 of this example is disposed close to the uppermost surface 330*h* in the use position of the air accommodating chamber 330. Therefore, in the use position, in a case where the ink in the liquid accommodating chamber 340 has flowed into the air accommodating chamber 330, a possibility that the ink may leak (flow out) toward the outside through the port opened to the air 318 can be reduced.

Figure 15A:
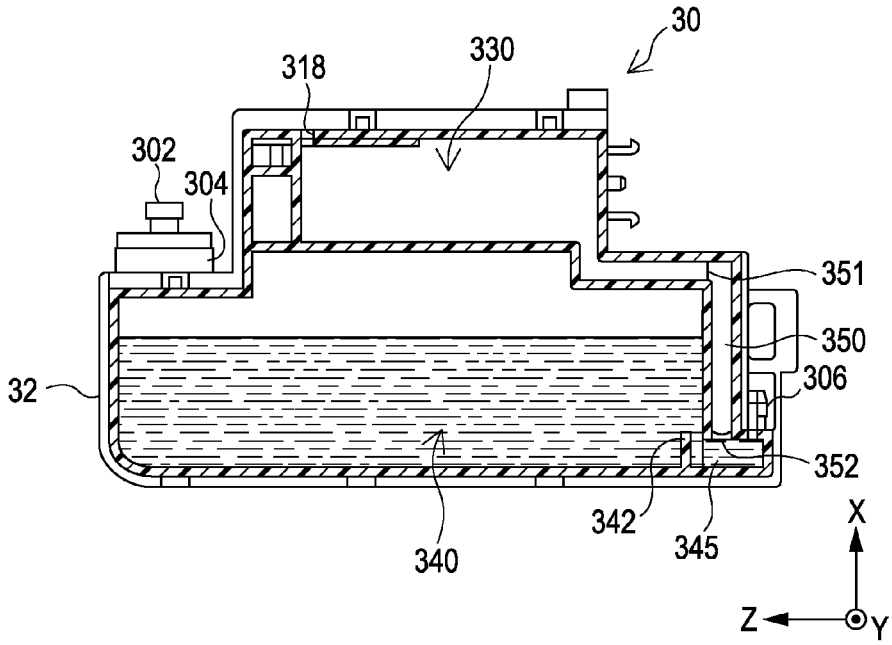
FIGS. 15A and 15B are diagrams for describing the state of ink in an injection position.
Figure 15B:
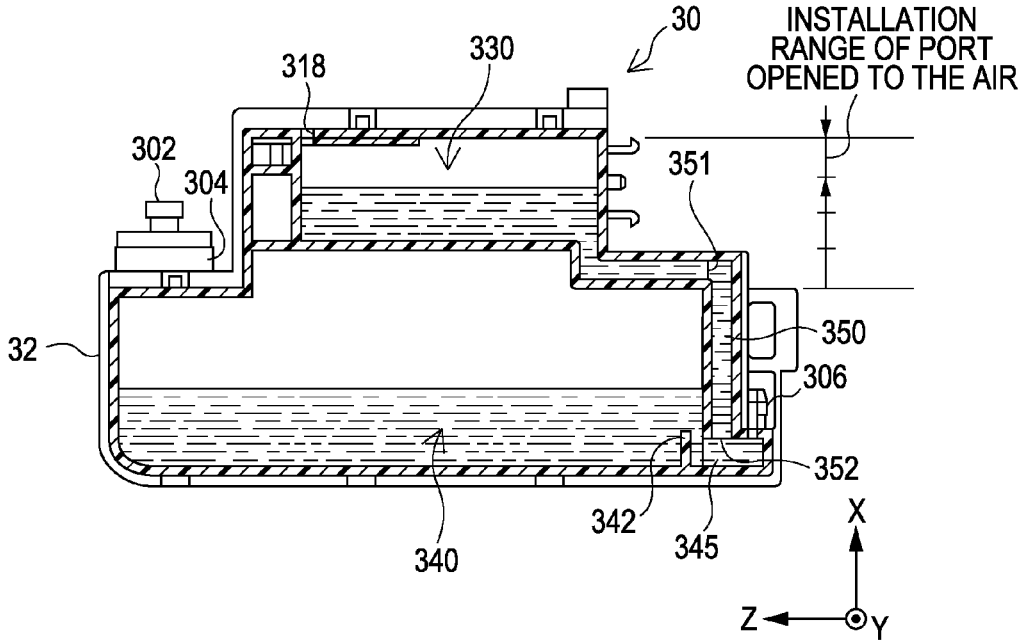

FIGS. 15A and 15B are diagrams for describing the state of ink in the injection position. FIG. 15A shows the state of ink in the ink tank 30 in a case where the ink tank 30 is exposed to low temperature environment in the injection position. FIG. 15B shows the state of ink in the ink tank 30 in a case where the ink tank 30 is exposed to high temperature environment in the injection position.

As shown in FIG. 15A, in the low temperature environment, a meniscus remains formed in the second flow path 350. In the injection position, when a difference between the pressure of air in the liquid accommodating chamber 340 and the pressure of air that is present in the air accommodating chamber 330 is within a given range, the ink in the liquid accommodating chamber 340 does not flow into the air accommodating chamber 330.

As shown in FIG. 15B, if the environment to which the ink tank 30 is exposed changes from the low temperature environment to the high temperature environment, air in the liquid accommodating chamber 340 expands. Then, the ink in the liquid accommodating chamber 340 is extruded due to expansion of air, so that some of the ink flows into the second flow path 350 and the air accommodating chamber 330. However, in the use position, since the port opened to the air 318 of this example is formed in the inner wall surface equivalent to the top face of the air accommodating chamber 330, in a case where the ink in the liquid accommodating chamber 340 has flowed into the air accommodating chamber 330, a possibility that the ink may flow out toward the outside through the port opened to the air 318 can be reduced.

Figure 16A:
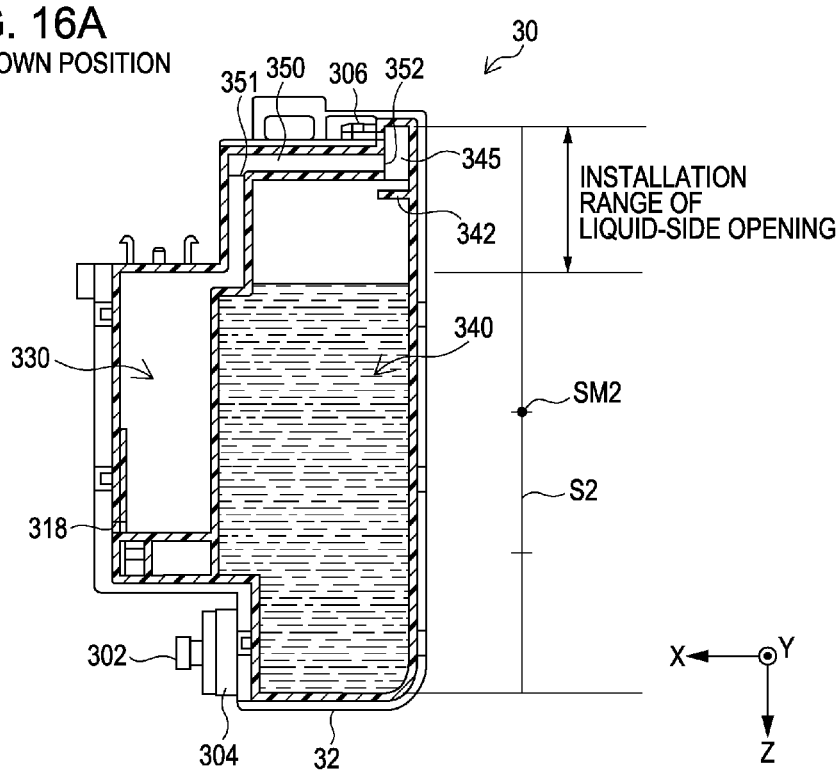
FIGS. 16A and 16B are diagrams for describing the state of ink in another position.
Figure 16B:
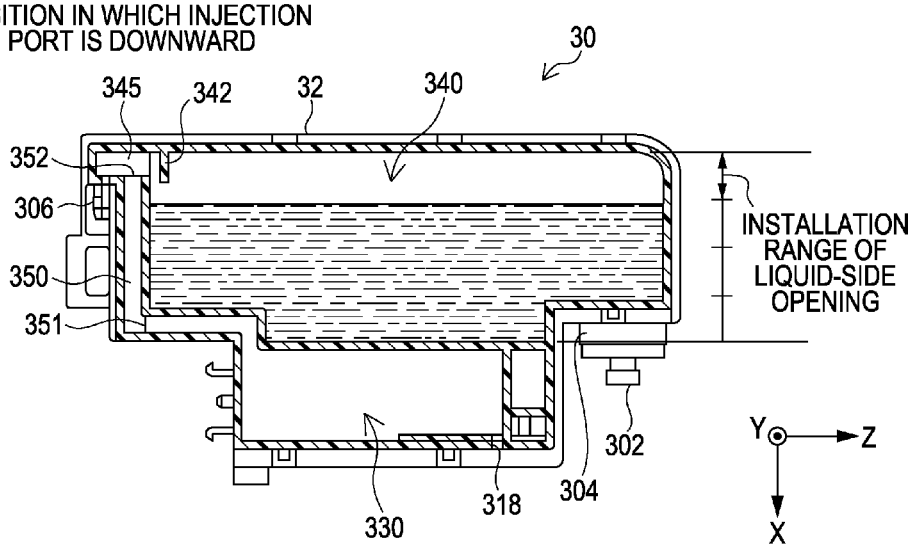

FIGS. 16A and 16B are diagrams for describing the state of ink in another position. FIG. 16A shows the state of ink in the ink tank 30 in an upside-down position. FIG. 16B shows the state of ink in the ink tank 30 in a position in which the liquid injection port 304 is vertically downward (hereinafter also referred to as a "downward position").

As shown in FIG. 16A, in a case where the ink tank 30 is in the upside-down position in which upper and lower sides are in a reverse relationship to the use position, the liquid-side opening 352 is disposed in the vicinity of the uppermost surface of the liquid accommodating chamber 340 in the upside-down position. Therefore, a possibility that ink may flow into the air accommodating chamber 330 through the liquid-side opening 352 can be reduced. Accordingly, a possibility that ink may flow out toward the outside through the port opened to the air 318 can be reduced.

As shown in FIG. 16B, in a case where it has become the downward position, the liquid-side opening 352 is disposed in the vicinity of the uppermost surface of the liquid accommodating chamber 340 in the downward position. Therefore, a possibility that ink may flow into the air accommodating chamber through the liquid-side opening 352 can be reduced. Accordingly, a possibility that ink may be leaked to the outside through the port opened to the air 318 can be reduced.

Figure 17A:
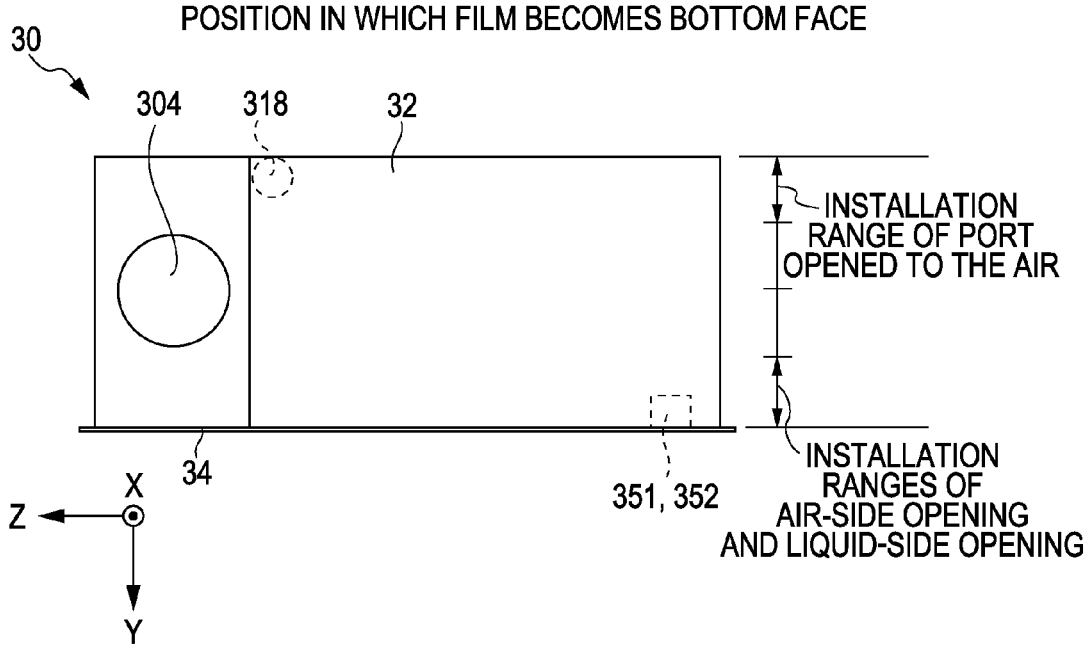
FIGS. 17A and 17B are a second diagram for describing the state of ink in another position.
Figure 17B:
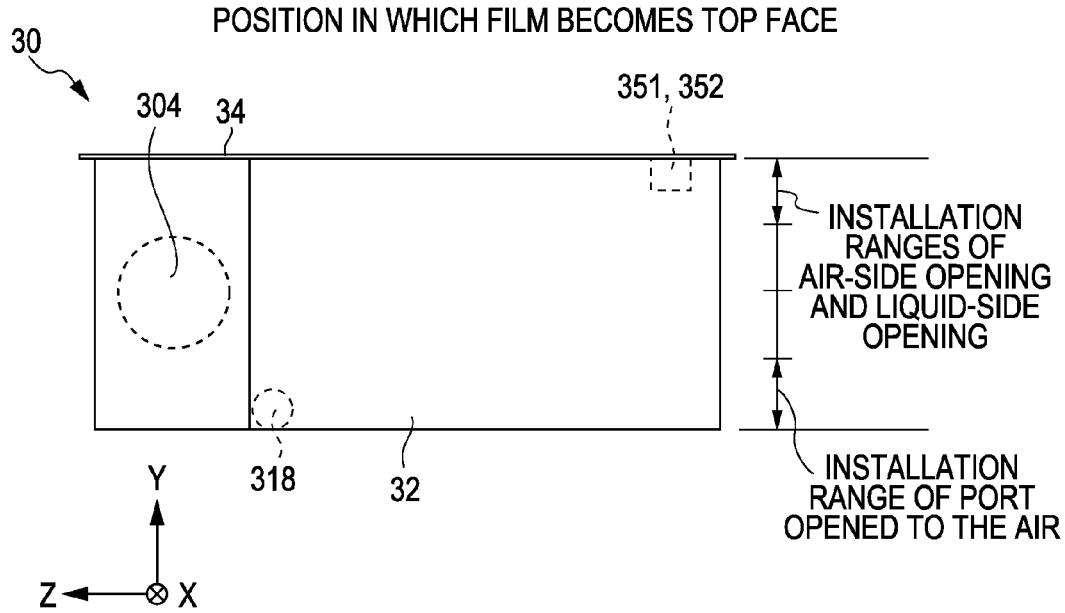

FIGS. 17A and 17B are a second diagram for describing the state of ink in another position. FIG. 17A is a diagram schematically illustrating the ink tank 30 in a position in which the film 34 (FIG. 6) becomes a bottom face (hereinafter also referred to as a "film bottom position"). FIG. 17B is a diagram schematically illustrating the ink tank 30 in a position in which the film 34 (FIG. 6) becomes a top face (hereinafter also referred to as a "film top position").

As shown in FIG. 17A, in a case where the ink tank 30 is in the film bottom position, the air-side opening 351 and the liquid-side opening 352 are disposed at the bottom. For this reason, there is a case where due to a change (for example, a change from a low temperature environment to a high temperature environment) in the environment to which the ink tank 30 is exposed, the ink in the liquid accommodating chamber 340 flows into the air accommodating chamber 330. However, since the port opened to the air 318 is disposed in the vicinity of the uppermost surface in the film bottom position, a possibility that ink may flow out to the outside through the port opened to the air 318 can be reduced.

As shown in FIG. 17B, in a case where the ink tank 30 is in the film top position, since the air-side opening 351 and the liquid-side opening 352 are disposed at the top, a possibility that the ink in the liquid accommodating chamber 340 may flow into the air accommodating chamber 330 can be reduced. Accordingly, a possibility that ink may flow out to the outside through the port opened to the air 318 can be reduced.

In this manner, in the ink tank 30 of the first example, since the port opened to the air 318, the air-side opening 351, and the liquid-side opening 352 are disposed in the predetermined position range (FIGS. 9A to 11B), even if a change in the state of the ink tank 30 (for example, a change in position of the ink tank or a change in environment to which the ink tank is exposed or the like) occurs, a possibility that ink may flow out from the port opened to the air 318 toward the outside can be reduced. Accordingly, a possibility that the sheet member 316 may be wet with ink can be reduced, so that a functional decline of the sheet member 316 can be suppressed. Further, since the liquid accommodating chamber 340 has the air retention portion 340*t*, in a case where the state of the ink tank 30 has changed, a possibility that the ink in the liquid accommodating chamber 340 may flow out from the port opened to the air 318 toward the outside can be still further reduced.

Further, the liquid injection port 304 is provided at the wall surface fc (the right side face fc) on the side where the air accommodating chamber 330 is disposed with respect to the liquid accommodating chamber 340, among the wall surfaces partitioning and forming the liquid accommodating chamber 340. That is, the liquid injection port 304 is provided at a face (the left side face fc) parallel to the vertical direction in the use position. Accordingly, when a user replenishes ink to the ink tank 30, it is possible to urge the user to change the position of the ink tank from the use position to the injection position. Further, since in the injection position, the air accommodating chamber 330 is located above the liquid accommodating chamber 340, a possibility that ink may flow into the air accommodating chamber 330 at the time of ink injection can be reduced. Accordingly, in the use position, it is possible to make a water head difference, which is generated by a difference in height between the head 17 and the ink liquid surface contacting with air in the ink tank 30, be within a given range. Therefore, it is possible to stably supply ink from the ink tank 30 to the printer 12.

Further, in the ink tank 30, the air accommodating chamber 330, the liquid accommodating chamber 340, or the second flow path 350 is formed by the tank main body 32 having a concave shape and the film 34 which seals the opening of the tank main body (FIG. 6). Accordingly, it is possible to easily form the respective rooms 330, 340, and 350 having a complicated shape.

B. SECOND EXAMPLE

Figure 18:
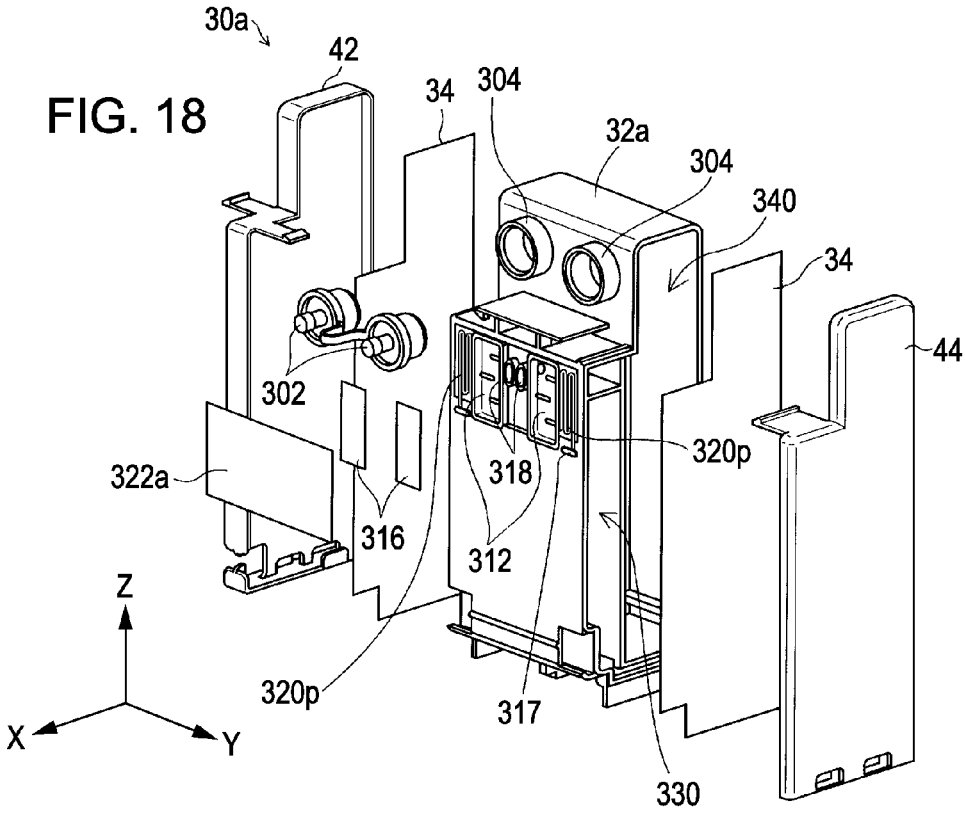
FIG. 18 is an exploded perspective view of an ink tank of the second example.
Figure 19:
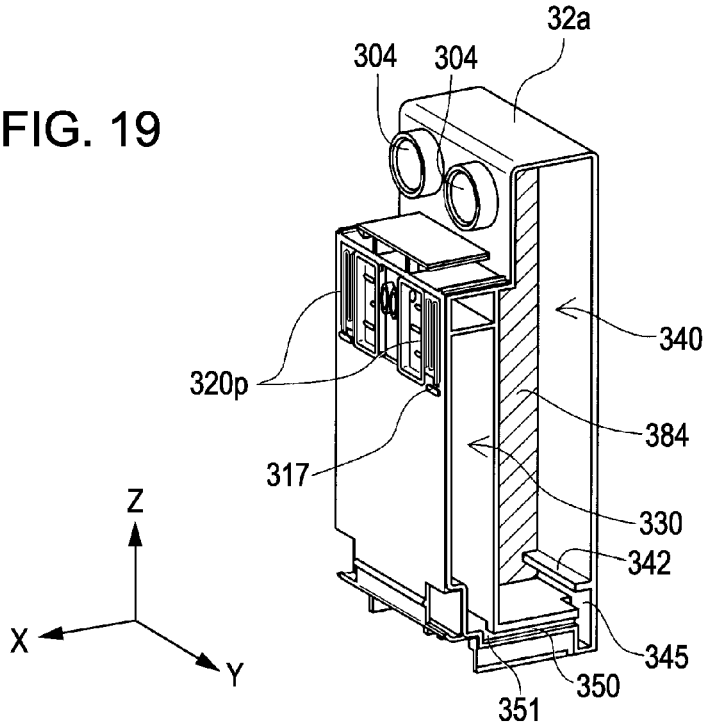
FIG. 19 is a perspective view of a tank main body of the second example.

FIG. 18 is an exploded perspective view of an ink tank 30*a* of the second example. FIG. 19 is a perspective view of a tank main body 32*a* of the second example. This example is different from the first example in that one ink tank 30*a* is provided with two flow paths opened to the air 300 and two liquid accommodating chambers 340 (FIG. 4). In addition, with respect to the same configuration as that in the first example, the same reference numeral is applied and explanation is omitted. Further, a positional relationship between the liquid injection port 304, the air-side opening 351, the liquid-side opening 352, and the port opened to the air 318, which the ink tank 30*a* of the second example includes, is the same as the positional relationship (FIGS. 9A to 11B, 13A, and 13B) in the first example.

As shown in FIG. 18, the ink tank 30*a* includes the tank main body 32*a*, two films 34, two sheet members 316, the film 322, two plug members 302, and cover members 42 and 44. In addition, a communication flow path 320*p* of the second example is made to be a serpentine flow path unlike the first example. Further, one film 322*a* is provided so as to cover two communication flow paths 320*p* and two gas-liquid separation chambers 312.

The tank main body 32*a* is molded by synthetic resin such as polypropylene. Further, the tank main body 32*a* is translucent, so that the amount of ink in the inside can be confirmed from the outside. The faces on the Y-axis positive direction side and the Y-axis negative direction side of the tank main body 32*a* are opened and each of the openings is sealed by the film 34. The cover members 42 and 44 are molded by synthetic resin such as polypropylene or polystyrene. The cover members 42 and 44 are attached to the tank main body 32*a* so as to cover the films 34, thereby protecting the films 34 from external impact or the like. Further, as shown in FIG. 19, the tank main body 32*a* has in the inside thereof a partition wall 384 that divides the internal space of the tank main body 32*a* into two. In addition, in order to facilitate understanding, single hatching is imparted to the partition wall 384.

As can be understood from the above explanation, it can also be said that the ink tank 30*a* of the second example has a configuration in which the rear faces ff (also referred to as the "facing wall surface portions ff") of the two tank main bodies 32 each having the configuration of the first example are constituted by a single common member 384 (the partition wall 384) and also the two tank main bodies 32 of the first example are integrally molded.

In this manner, the ink tank 30*a* of the second example can be easily formed by an ink tank in which the two ink tanks 30 of the first example are combined. Accordingly, it is possible to improve the production efficiency of the ink tank 30*a*.

C. MODIFIED EXAMPLES

In addition, elements other than the elements described in the independent claims among the constituent elements in the above examples are additional elements and can be appropriately omitted. Further, the invention is not limited to the above examples or embodiments and can be implemented in various forms within the scope that does not depart from the gist thereof, and for example, the following modifications are also possible.

C-1. First Modified Example

In the above examples, the air accommodating chamber 330 is provided with the upper accommodating chamber 337 of a rectangular parallelepiped shape, the lower accommodating chamber 339 of a rectangular parallelepiped shape having volume different from that of the upper accommodating chamber 337, and the communication flow path 338 making the upper and lower accommodating chambers communicate with each other. However, the shape of the air accommodating chamber 330 is not limited to thereto. That is, it is acceptable if it is a configuration having the given volume capable of retaining ink flowed back from the liquid accommodating chamber 340. For example, the air accommodating chamber 330 may also be configured only by one chamber of a rectangular parallelepiped shape or may also have a configuration having three or more of accommodating chambers.

C-2. Second Modified Example

In the above examples, the port opened to the air 318 is disposed at a position that is included in the first corner portion 330*s*1 of the two corner portions 330*s*1 and 330*s*2 farthest from the liquid accommodating chamber 340 among the corner portions 330*s*1 to 330*s*4 of the vertical projection plane 330*hh* (FIG. 9B). However, it is not limited thereto. The port opened to the air 318 may also be disposed at a position that is included in any one of the other corner portions 330*s*2 to 330*s*4 of the vertical projection plane 330*hh*. However, the port opened to the air 318 needs to be disposed at a position closer to the uppermost surface 330*h* than the air chamber middle point SM1 with respect to the vertical direction in the use position. In addition, by disposing the port opened to the air 318 at a position that is included in any one of the corner portions 330*s*1 to 330*s*4, the disposition positions of the air-side opening 351 and the liquid-side opening 352 are also changed correspondingly. That is, the air-side opening 351 is disposed at the corner portion that is in a diagonal relationship with the corner portion in which the port opened to the air 318 is included with respect to the vertical projection plane 330*hh*. Further, the liquid-side opening 352 is disposed at the corner portion that is at a position equivalent to a diagonal relationship with the corner portion in which the port opened to the air 318 is included with respect to the vertical projection plane 340*hh*. Even in this way, similarly to the above examples, a possibility that ink may flow out from the port opened to the air 318 toward the outside can be reduced even in a case where the state of the ink tank 30 has changed.

C-3. Third Modified Example

In the above examples, each of the ink tanks 30 and 30*a* has the liquid holding portion 345. However, it needs not have the liquid holding portion 345. That is, the partition wall 342 needs not be provided in the liquid accommodating chamber 340. Even in this way, similarly to the above examples, a possibility that ink may flow out from the port opened to the air 318 toward the outside can be reduced.

C-4. Fourth Modified Example

In the above examples and modified examples, the ink tank 30 or 30*a* which is used in the printer 12 as a liquid accommodating container has been described as an example. However, the invention is not limited thereto, but can be applied to a liquid accommodating container capable of supplying liquid to a liquid ejecting apparatus such as an apparatus provided with a head for ejecting a color material of, for example, a liquid crystal display or the like, an apparatus provided with an electrode material (conductive paste) ejecting head which is used for the electrode formation of an organic EL display, a surface-emitting display (FED), or the like, an apparatus provided with a biological organic matter ejecting head which is used for the manufacturing of biochips, an apparatus provided with a sample ejecting head as a precision pipette, a cloth printing apparatus, or a micro-dispenser. Here, in the liquid accommodating container, the liquid injection port that injects liquid and the port opened to the air for introducing air into the liquid accommodating container are separately provided. When using the liquid accommodating container in various liquid ejecting apparatuses described above, it is preferable if liquid (a color material, conductive paste, biological organic matter, or the like) according to the type of liquid that various liquid ejecting apparatuses eject is contained in the liquid accommodating container. Further, the invention can also be applied as a liquid ejecting system which includes each of various liquid ejecting apparatuses and a liquid accommodating container corresponding to each of various liquid ejecting apparatuses.

What is claimed is:

1. A liquid accommodating container for supplying liquid to a liquid ejecting apparatus, comprising:

a liquid accommodating chamber for accommodating the liquid;

a liquid injection port which is for injecting the liquid into the liquid accommodating chamber and on which a plug member that blocks the liquid injection port is detachably mounted;

a flow path opened to the air for introducing external air into the liquid accommodating chamber in accordance with consumption of the liquid in the liquid accommodating chamber; and a lead-out flow path having one end portion disposed in the liquid accommodating chamber and the other end portion opened toward the outside, thereby making the liquid in the liquid accommodating chamber flow toward the outside, wherein the flow path opened to the air includes an air accommodating chamber which has a given volume and is located above the liquid accommodating chamber in an injection position of the liquid accommodating container when injecting the liquid into the liquid accommodating chamber, a first flow path having one end portion opened in the air accommodating chamber and the other end portion opened toward the outside, thereby making the air accommodating chamber communicate with the outside, and a second flow path having one end portion opened in the air accommodating chamber and the other end portion opened in the liquid accommodating chamber, thereby making the air accommodating chamber and the liquid accommodating chamber communicate with each other, and capable of holding the liquid by forming a meniscus, and in a use position of the liquid accommodating container when supplying the liquid to the liquid ejecting apparatus, a port opened to the air that is one end portion of the first flow path is provided at a position that is closer to an air chamber uppermost surface than an air chamber middle point which is the middle point of a line segment connecting the air chamber uppermost surface and an air chamber lowermost surface of the air accommodating chamber, with respect to the vertical direction, and that is included in a first corner portion which is one of four corner portions of a first rectangular outermost frame projection plane which is a vertical projection plane which is formed when an inner face of the air accommodating chamber is vertically projected vertically downward in the use position, an air-side opening that is one end portion of the second flow path is provided at a position that is closer to the air chamber lowermost surface than the air chamber middle point and is included in a second corner portion which is at a diagonal position to the first corner portion, among the four corner portions of the outermost frame projection plane, and a liquid-side opening that is the other end portion of the second flow path is provided at a position satisfying the following conditions (a) and (b), (a) a position closer to a liquid chamber lowermost surface than a liquid chamber middle point which is the middle point of a line segment connecting a liquid chamber uppermost surface and the liquid chamber lowermost surface of the liquid accommodating chamber, with respect to the vertical direction in the use position, and (b) a position which is included in a third corner portion that is one of four corner portions of a second rectangular outermost frame projection plane which is a vertical projection plane which is formed when an inner face of the liquid accommodating chamber is vertically projected vertically downward in the use position, and that is at a position equivalent to a diagonal position to the first corner portion in the first rectangular outermost frame projection plane.

2. The liquid accommodating container according to claim 1, wherein the liquid injection port is provided at an air-side wall surface on the side where the air accommodating chamber is disposed with respect to the liquid accommodating chamber, among wall surfaces partitioning and forming the liquid accommodating chamber, and in the injection position, the air-side wall surface of the liquid accommodating chamber becomes a top face.

3. The liquid accommodating container according to claim 1, wherein a liquid outlet that is one end portion of the lead-out flow path is provided in the liquid accommodating chamber so as to be located at a position closer to a lowermost surface than a liquid chamber middle point that is the middle point of a line segment connecting an uppermost surface and the lowermost surface of the liquid accommodating chamber, with respect to the vertical direction in each of the injection position and the use position of the liquid accommodating container.

4. The liquid accommodating container according to claim 1, wherein the liquid accommodating chamber, the air accommodating chamber, and the second flow path are formed by a container main body of a concave shape in which one face is opened, and a film which blocks the opening.

5. The liquid accommodating container according to claim 4, further comprising: a cover member that is for protecting the film and covers the film.

6. A tank unit comprising:

a plurality of liquid accommodating containers which is the liquid accommodating container according to claim 4 and in which a facing wall surface portion facing the opening has approximately the same shape as the opening, wherein the plurality of liquid accommodating containers is stacked such that the film of one liquid accommodating container is covered by the facing wall surface portion of another adjacent liquid accommodating container.

7. A tank unit comprising:

two liquid accommodating containers according to claim 4, wherein each facing wall surface portion facing each opening of the two liquid accommodating containers is constituted by a single common member, and the two container main bodies are integrally molded.

8. A liquid ejecting system comprising:

the liquid accommodating container according to claim 1;

a liquid ejecting apparatus which includes a head for ejecting the liquid onto a target; and a flow tube that connects the liquid accommodating container and the liquid ejecting apparatus, thereby making the liquid in the liquid accommodating chamber flow to the liquid ejecting apparatus.

9. A liquid ejecting system comprising:

the liquid accommodating container according to claim 2;

a liquid ejecting apparatus which includes a head for ejecting the liquid onto a target; and a flow tube that connects the liquid accommodating container and the liquid ejecting apparatus, thereby the liquid in the liquid accommodating chamber flow to the liquid ejecting apparatus.

10. A liquid ejecting system comprising:

the liquid accommodating container according to claim 3;

a liquid ejecting apparatus which includes a head for ejecting the liquid onto a target; and a flow tube that connects the liquid accommodating container and the liquid ejecting apparatus, thereby the liquid in the liquid accommodating chamber flow to the liquid ejecting apparatus.

11. A liquid ejecting system comprising:

the liquid accommodating container according to claim 4;

a liquid ejecting apparatus which includes a head for ejecting the liquid onto a target; and a flow tube that connects the liquid accommodating container and the liquid ejecting apparatus, thereby the liquid in the liquid accommodating chamber flow to the liquid ejecting apparatus.

12. The liquid ejecting system according to claim 8, wherein the liquid ejecting apparatus is a printer, and the liquid accommodating chamber of the liquid accommodating container accommodates ink.

13. The liquid ejecting system according to claim 9, wherein liquid ejecting apparatus is a printer, and the liquid accommodating chamber of the liquid accommodating container accommodates ink.

14. The liquid ejecting system according to claim 10, wherein liquid ejecting apparatus is a printer, and the liquid accommodating chamber of the liquid accommodating container accommodates ink.

15. The liquid ejecting system according to claim 11, wherein liquid ejecting apparatus is a printer, and the liquid accommodating chamber of the liquid accommodating container accommodates ink.

* * * * *